US012540769B2

(12) United States Patent
Park et al.

(10) Patent No.: US 12,540,769 B2
(45) Date of Patent: Feb. 3, 2026

(54) REFRIGERATOR

(71) Applicant: LG ELECTRONICS INC., Seoul (KR)

(72) Inventors: Kyong Bae Park, Seoul (KR); Sangbok Choi, Seoul (KR); Sungwook Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 169 days.

(21) Appl. No.: 18/019,764

(22) PCT Filed: Jul. 19, 2021

(86) PCT No.: PCT/KR2021/009253

§ 371 (c)(1),
(2) Date: Feb. 3, 2023

(87) PCT Pub. No.: WO2022/030807

PCT Pub. Date: Feb. 10, 2022

(65) Prior Publication Data

US 2023/0288124 A1 Sep. 14, 2023

(30) Foreign Application Priority Data

Aug. 6, 2020 (KR) ..... 10-2020-0098363

(51) Int. Cl.
*F25D 21/02* (2006.01)
*F25D 21/00* (2006.01)
*F25D 21/06* (2006.01)

(52) U.S. Cl.
CPC ..... *F25D 21/02* (2013.01); *F25D 21/006* (2013.01); *F25D 21/06* (2013.01)

(58) Field of Classification Search
CPC ..... F25D 21/006; F25D 2400/04; F25D 2700/12; F25D 21/02; F25B 2700/2117; F25B 2600/112; F25B 2400/01
See application file for complete search history.

(56) References Cited

U.S. PATENT DOCUMENTS

| | | | | | |
|---|---|---|---|---|---|
| 3,355,904 | A * | 12/1967 | Sutton, Jr. | G05D 11/13 | 73/196 |
| 5,934,088 | A * | 8/1999 | Takeda | F25B 49/005 | 62/127 |
| 9,127,875 | B2 * | 9/2015 | Hall | F25D 21/006 | |
| 9,557,091 | B1 * | 1/2017 | Zardo | F25D 23/061 | |
| 2005/0281669 | A1 * | 12/2005 | Sohn | F04D 29/422 | 415/204 |
| 2009/0113923 | A1 * | 5/2009 | Young | F25D 17/065 | 700/282 |
| 2018/0031298 | A1 * | 2/2018 | Kim | F25D 25/025 | |
| 2018/0347871 | A1 * | 12/2018 | Park | F25D 23/087 | |
| 2019/0041119 | A1 * | 2/2019 | Kim | F25D 17/08 | |

FOREIGN PATENT DOCUMENTS

| | | | |
|---|---|---|---|
| JP | 6145684 | B2 | 6/2017 |
| KR | 10-2019-0112482 | A | 10/2019 |

* cited by examiner

*Primary Examiner* — Jianying C Atkisson
*Assistant Examiner* — Meraj A Shaikh
(74) *Attorney, Agent, or Firm* — Bryan Cave Leighton Paisner LLP

(57) ABSTRACT

A refrigerator is designed considering pressure distribution around a cooling fan with respect to a fluid outlet of a frost detecting device provided for frosting detection, so that the design may be efficiently perform with respect to the frost detecting device and precise frosting detection may be performed.

14 Claims, 24 Drawing Sheets

【Figure 1】
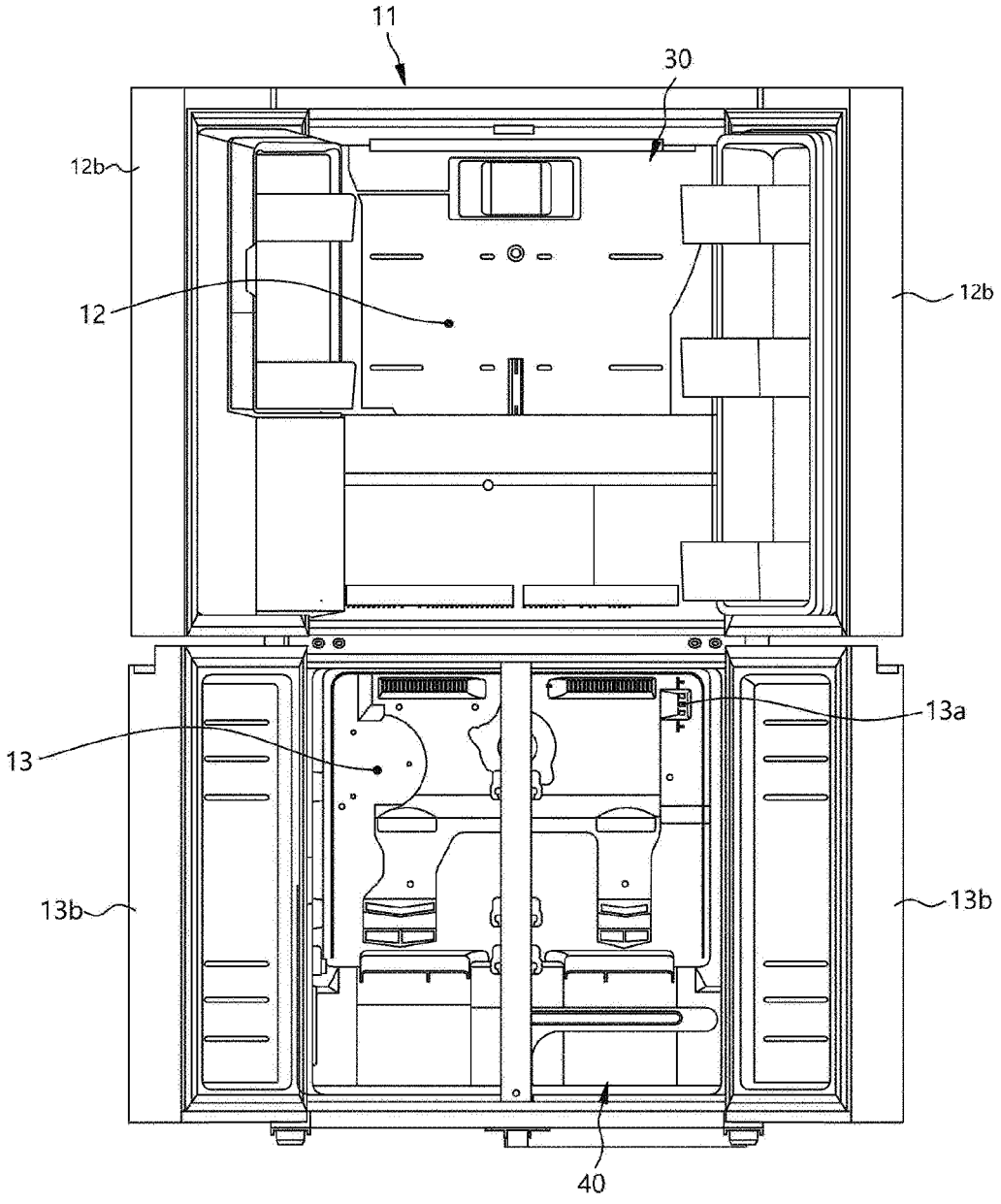

【Figure 2】
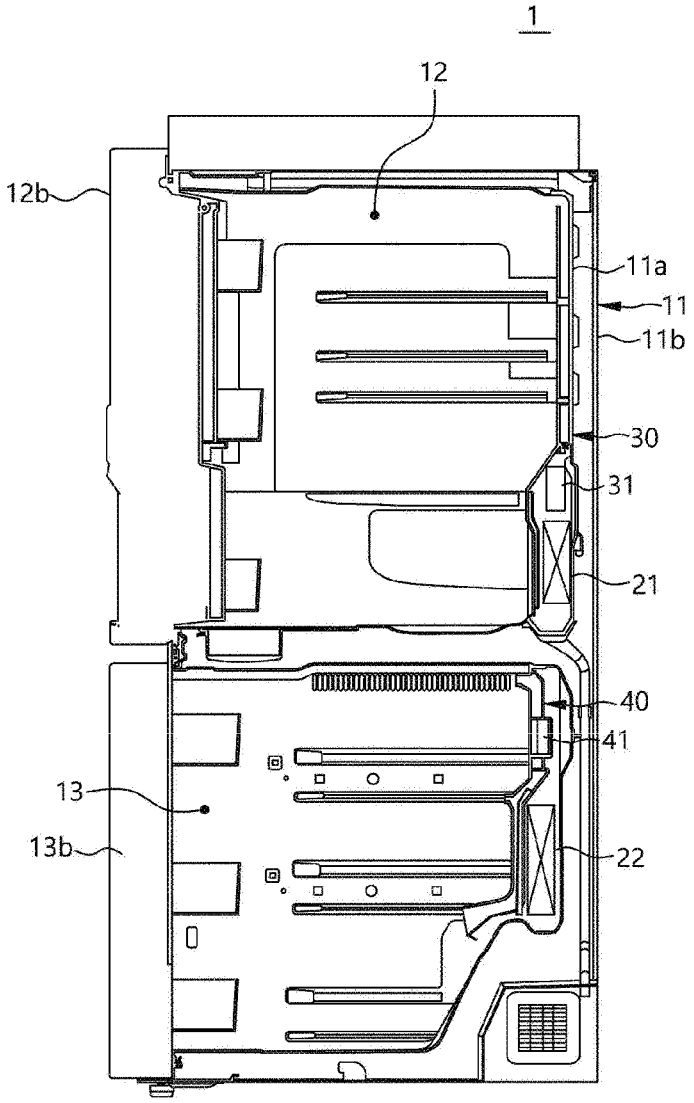

【Figure 3】
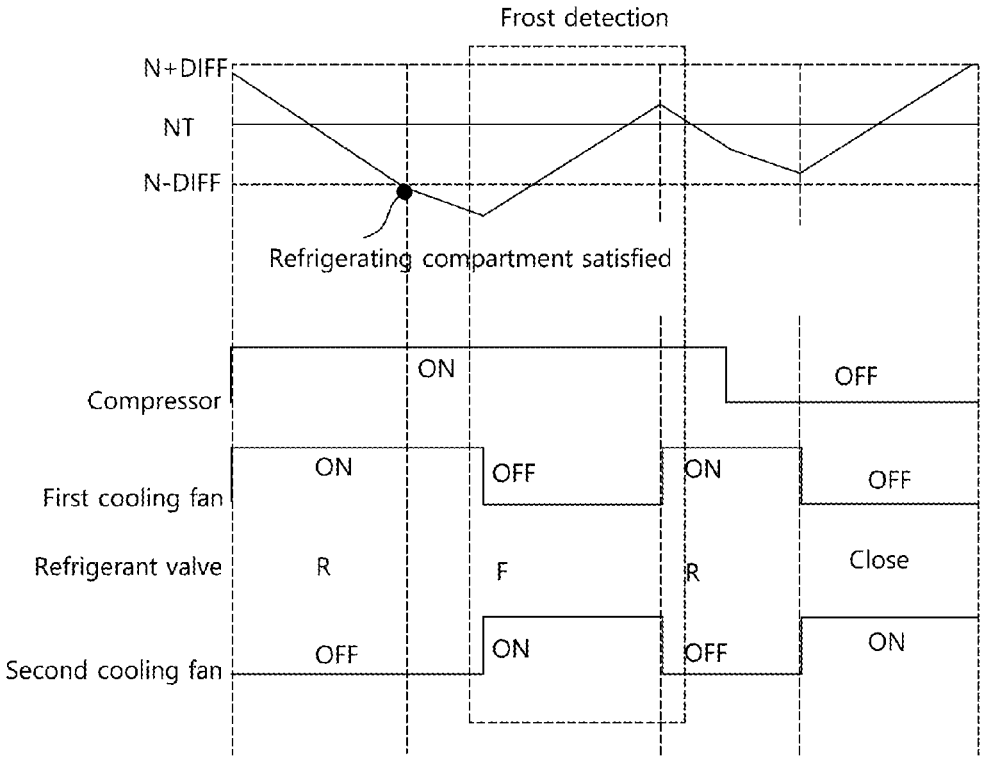
【Figure 4】
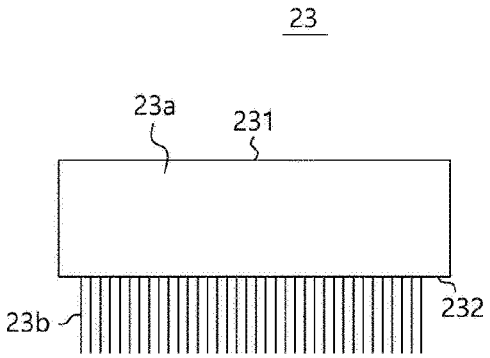

【Figure 5】
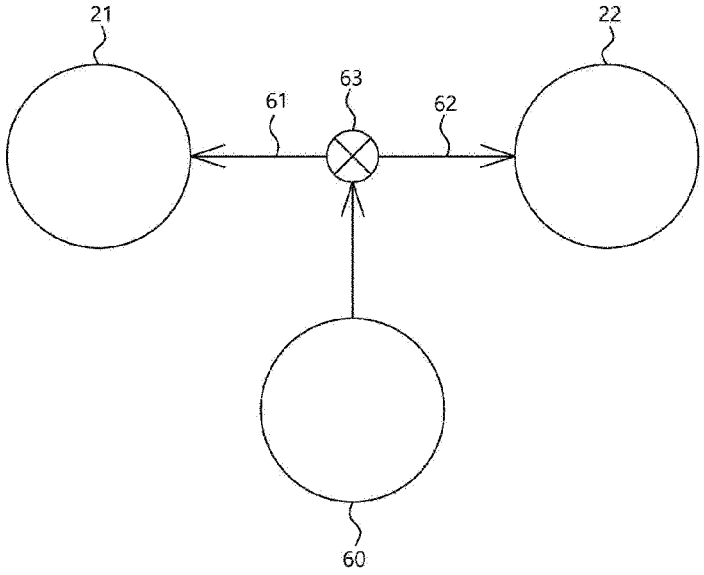

【Figure 6】
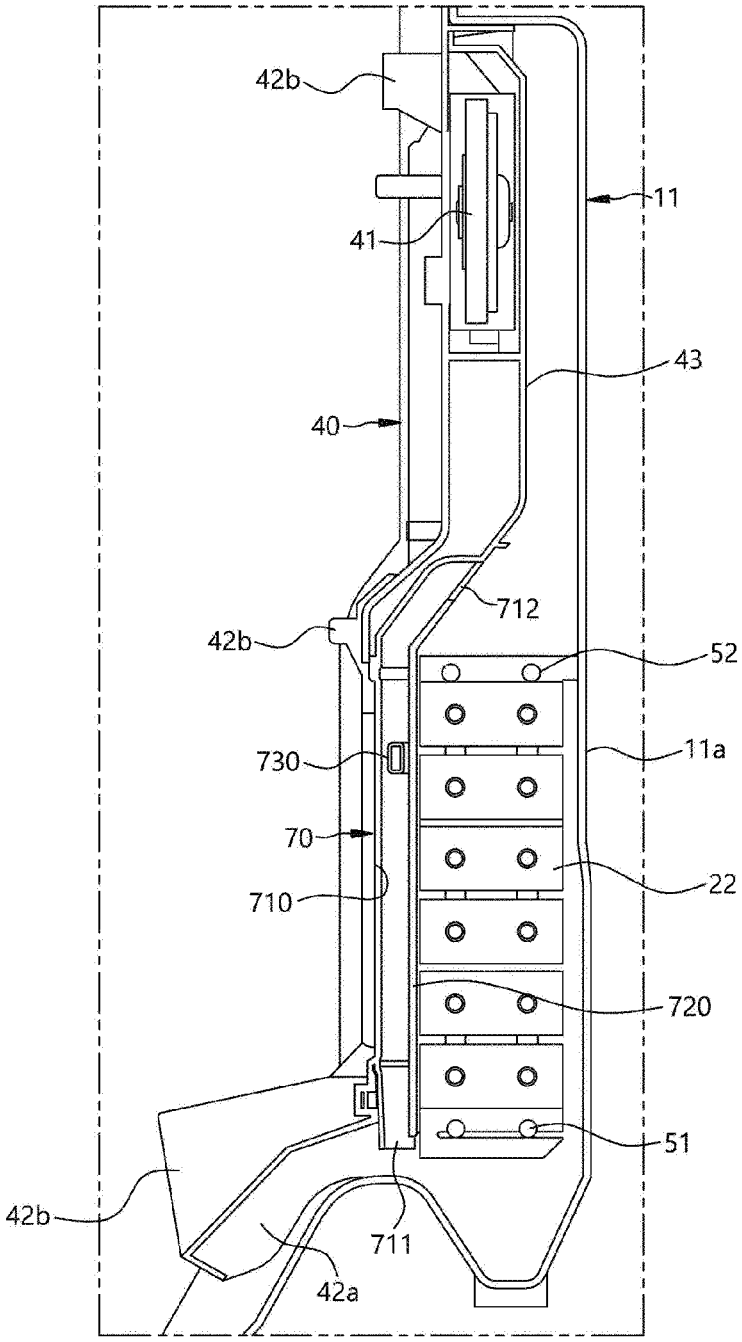

【Figure 7】
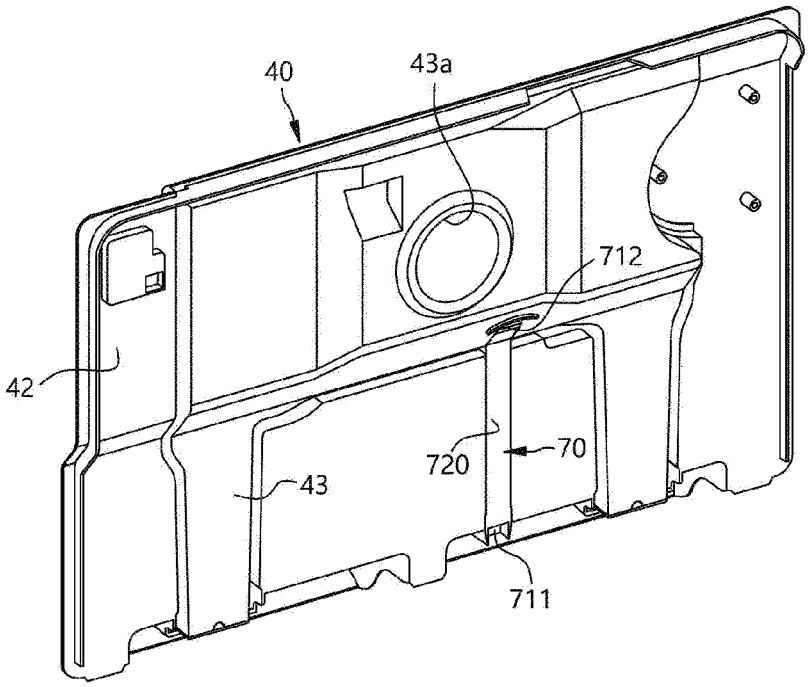

【Figure 8】
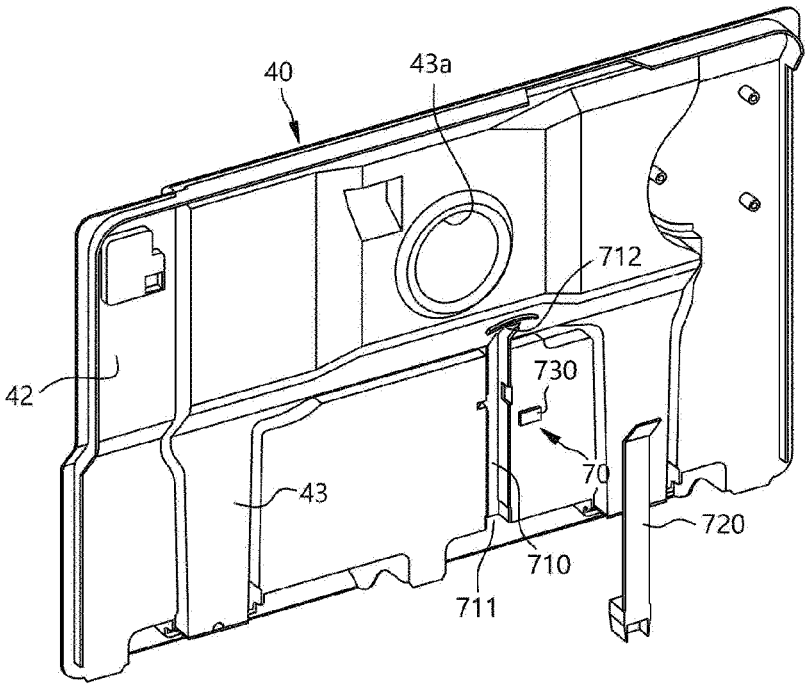

【Figure 9】
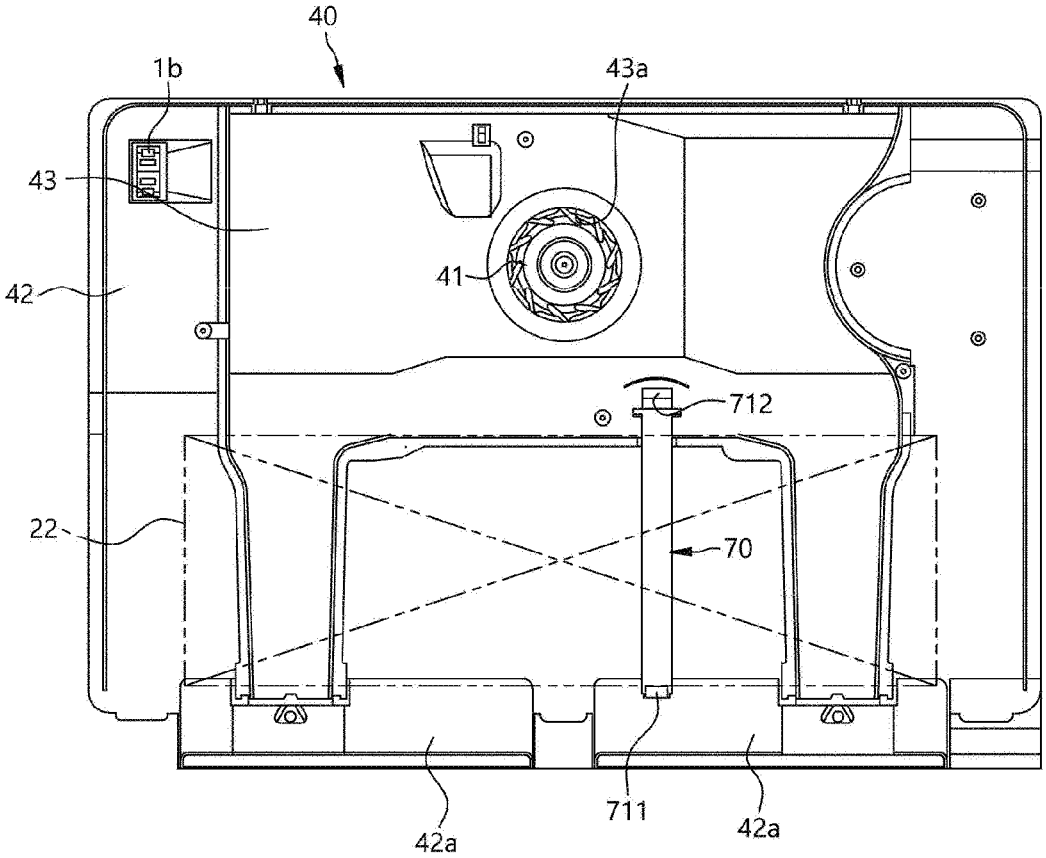

【Figure 10】
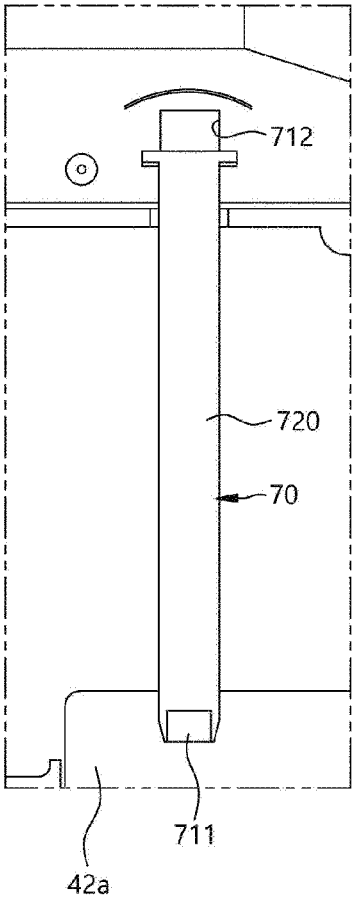

【Figure 11】
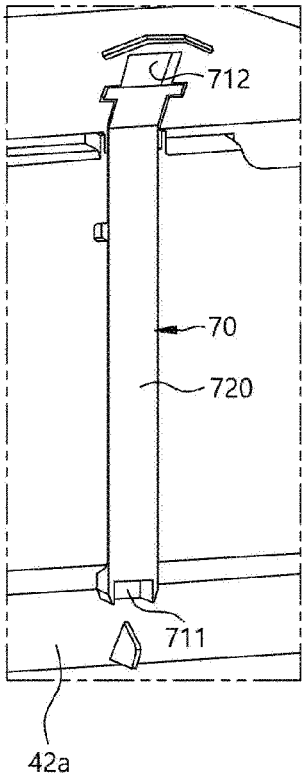

【Figure 12】
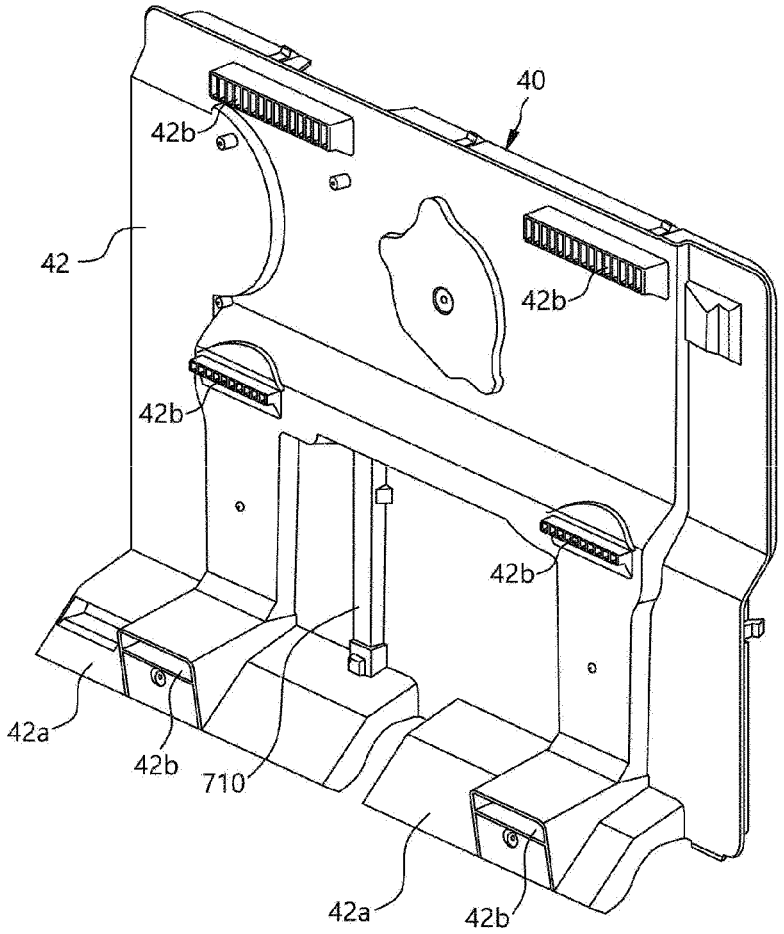

【Figure 13】
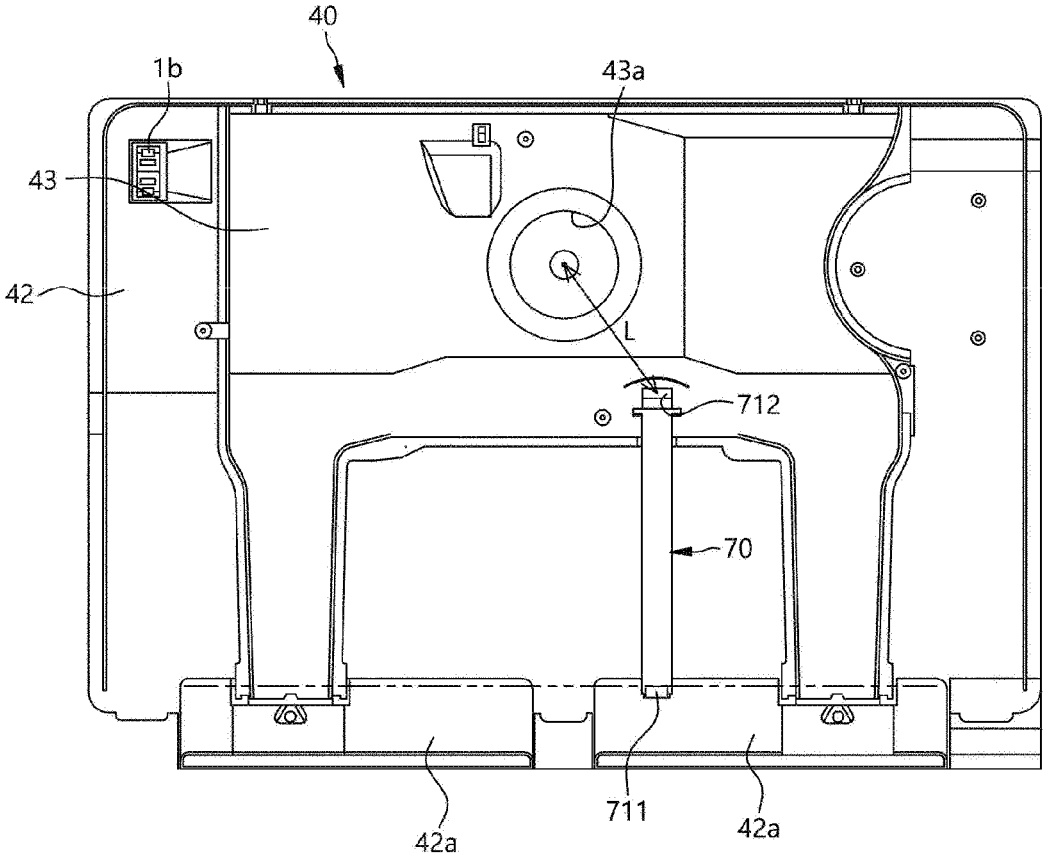

【Figure 14】
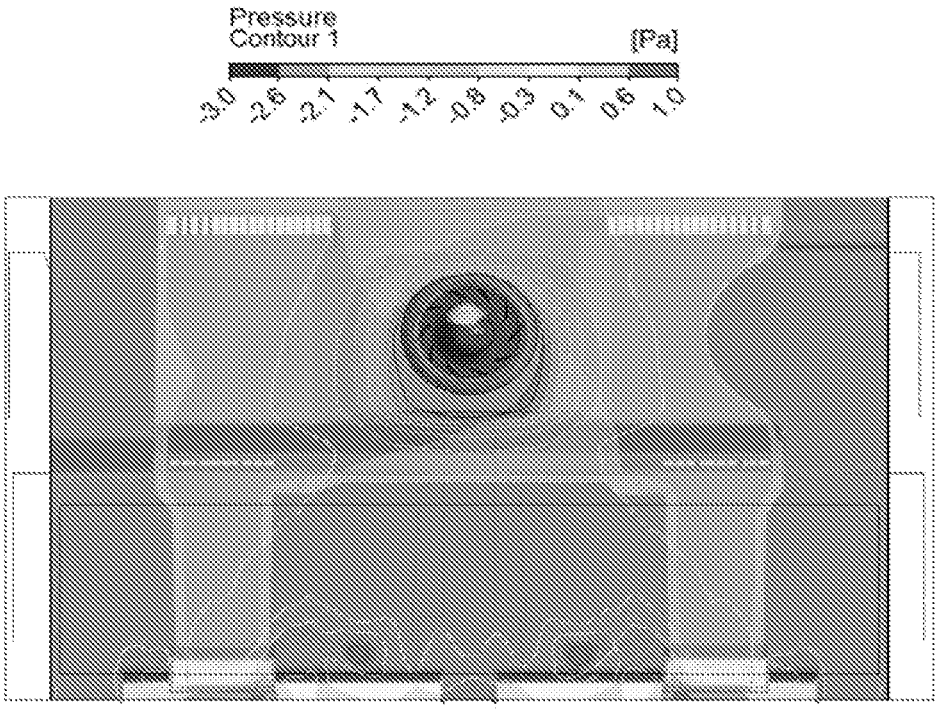

【Figure 15】
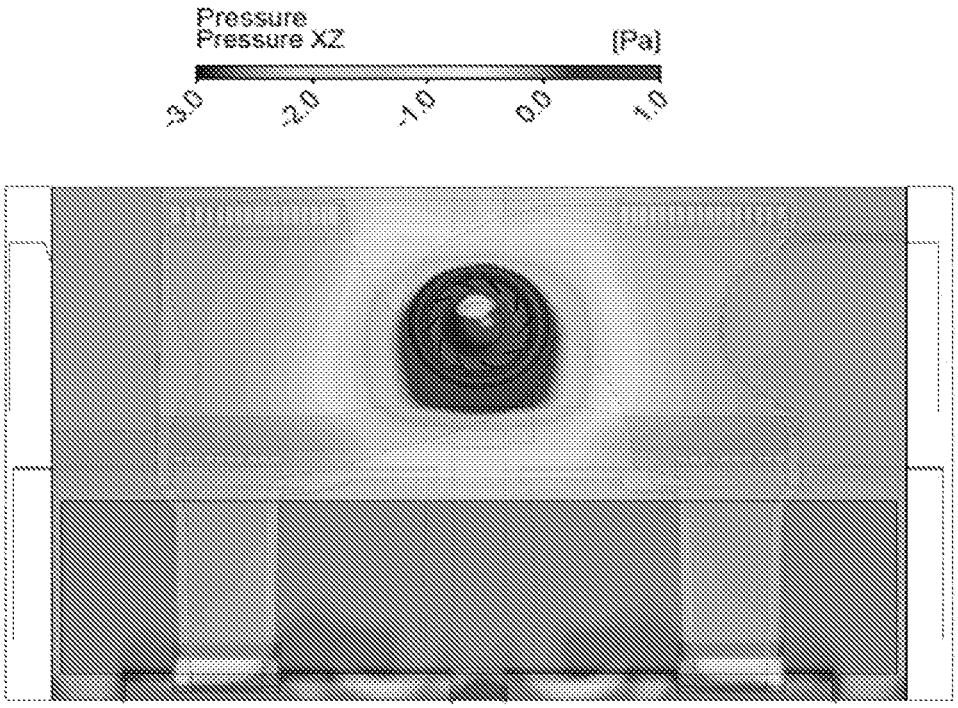
【Figure 16】
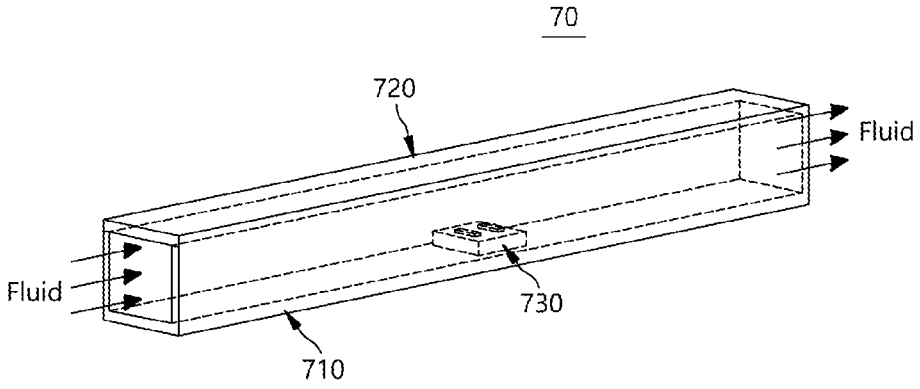

【Figure 17】
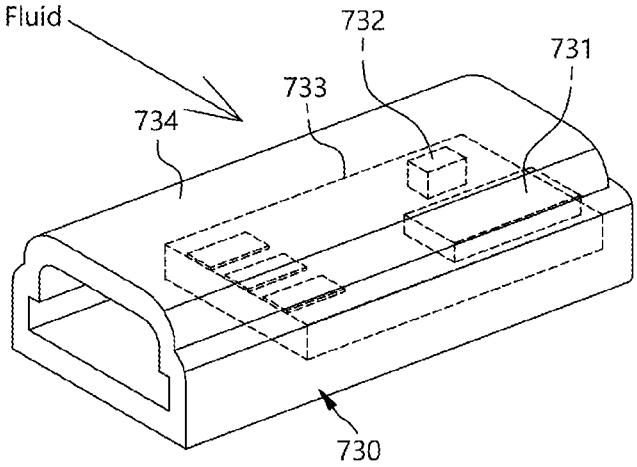
【Figure 18】
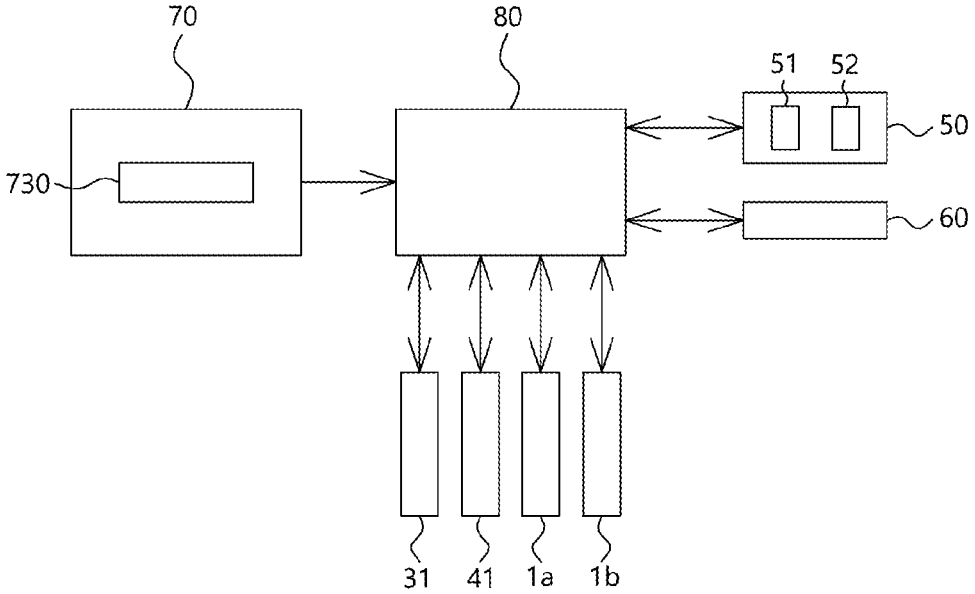

【Figure 19】
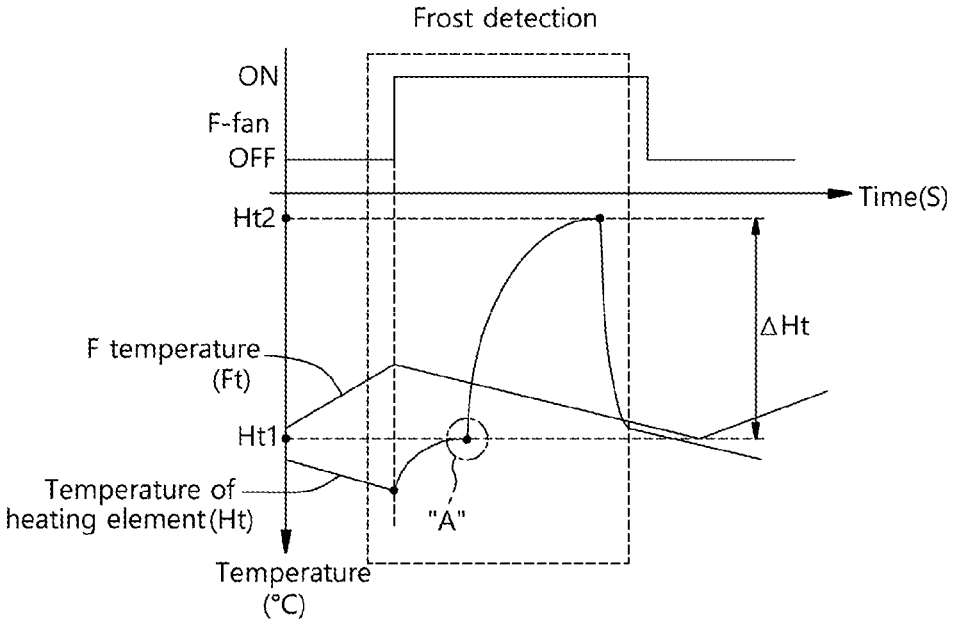
【Figure 20】
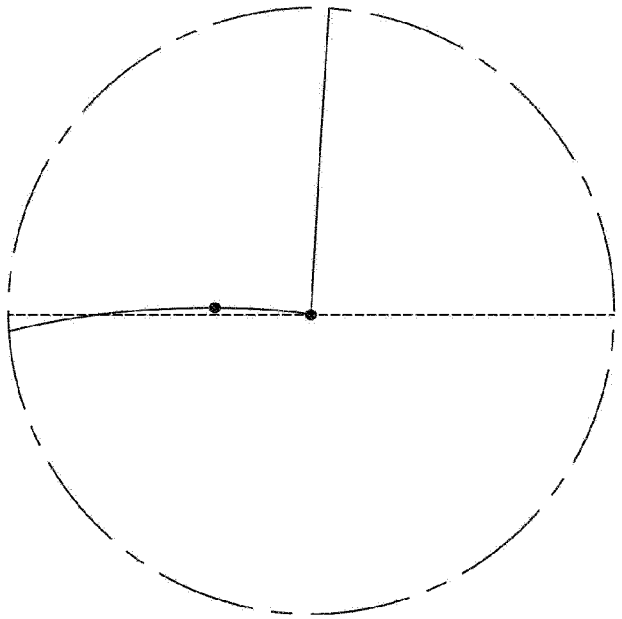

【Figure 21】
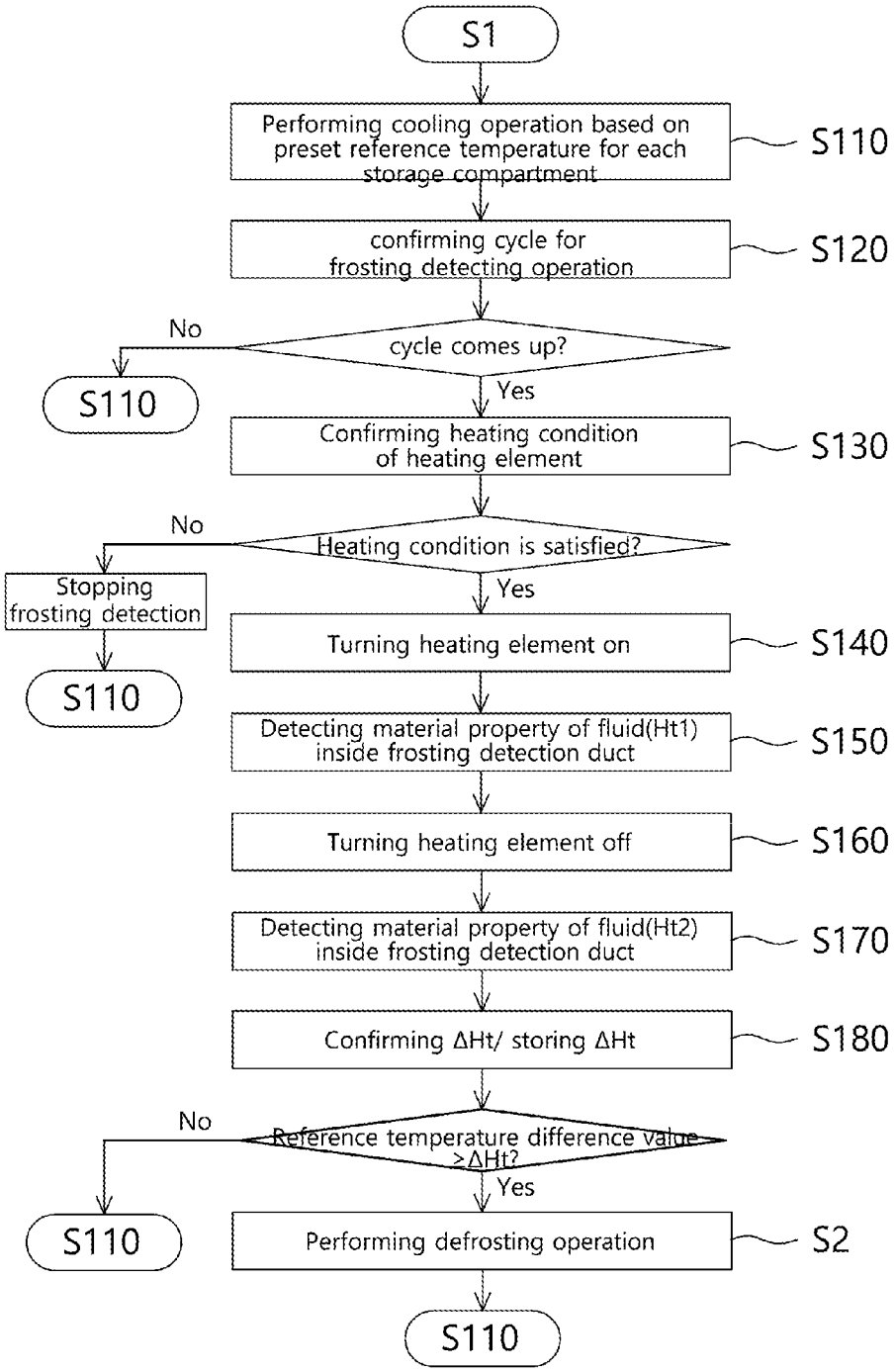

【Figure 22】
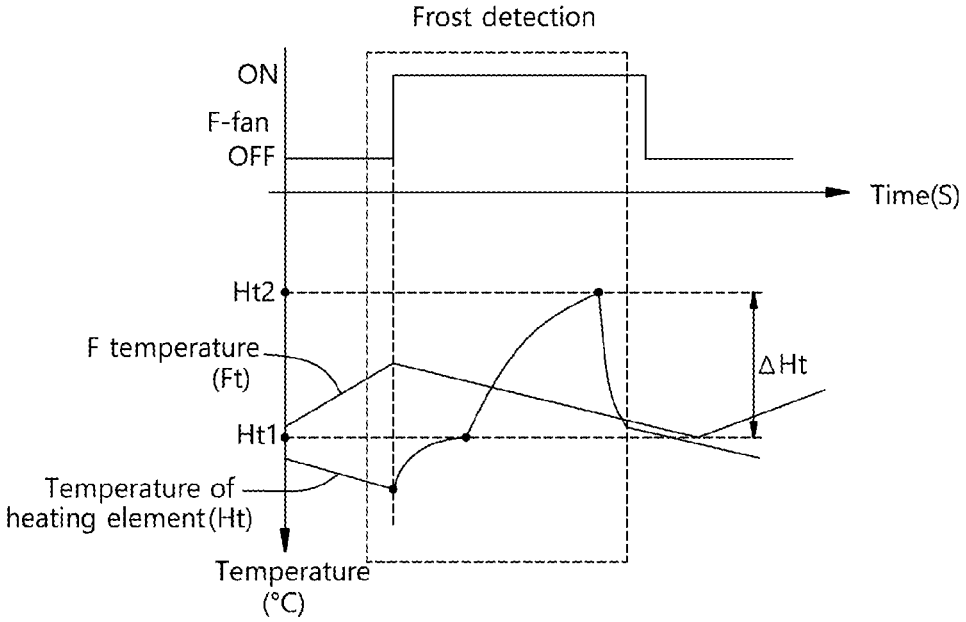

【Figure 23】
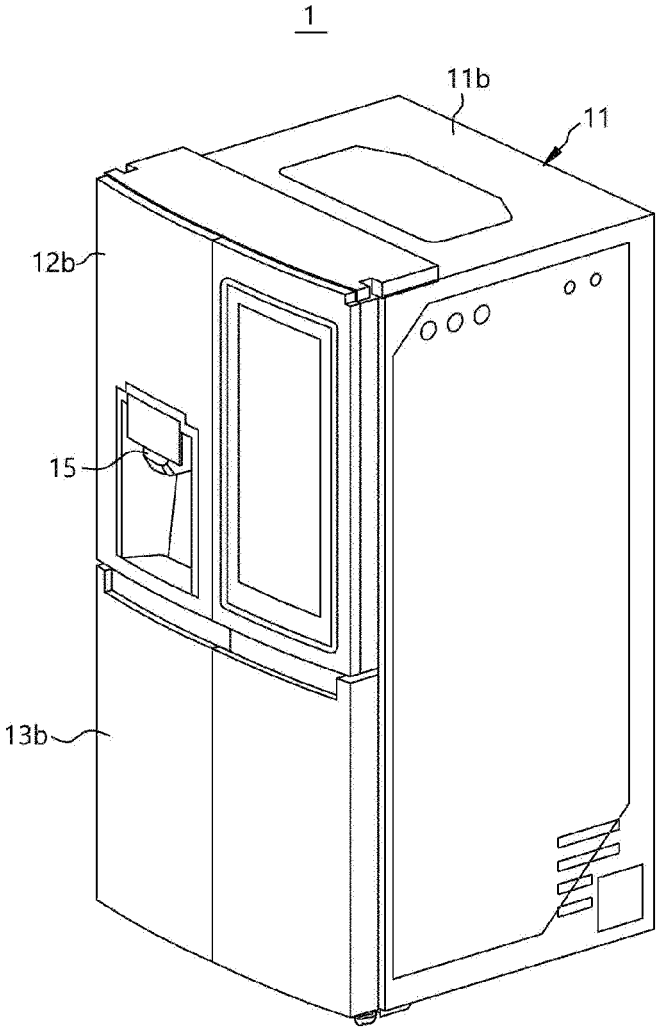

【Figure 24】
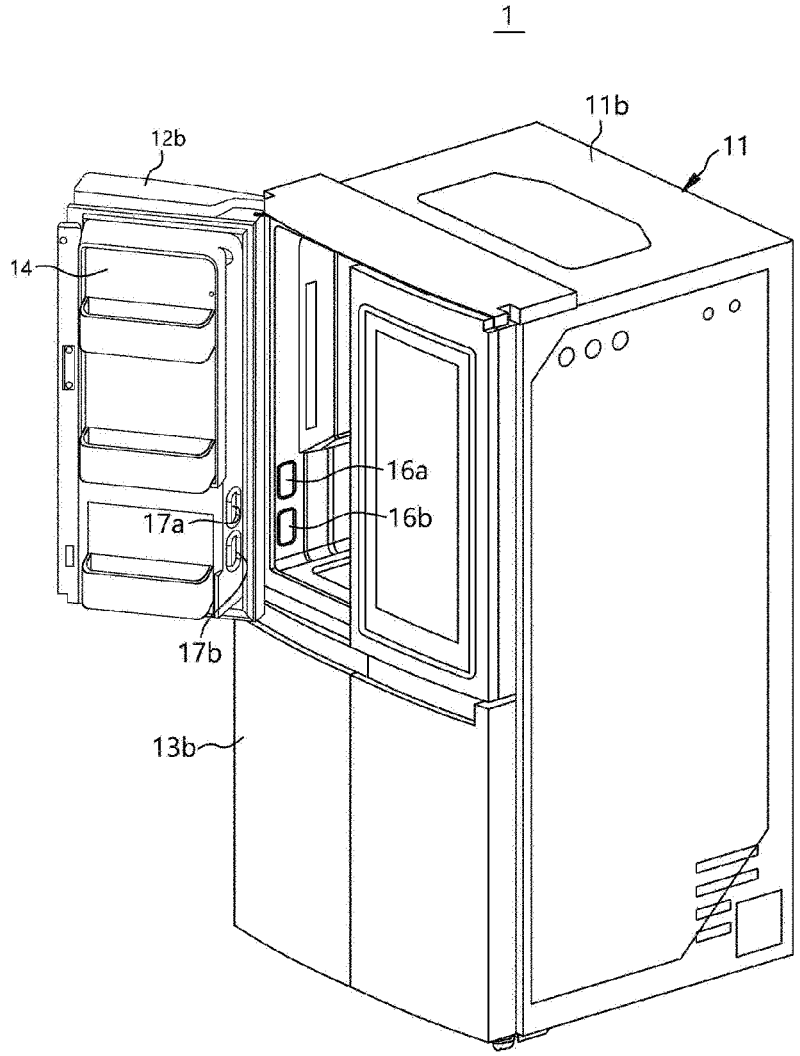

【Figure 25】
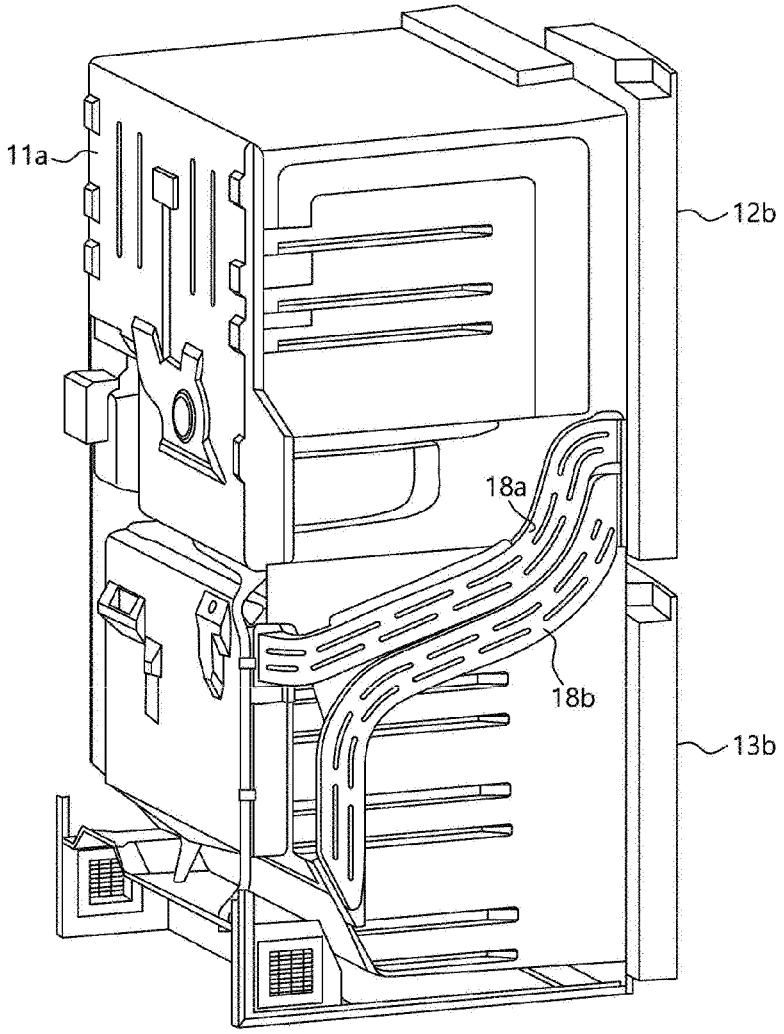

【Figure 26】
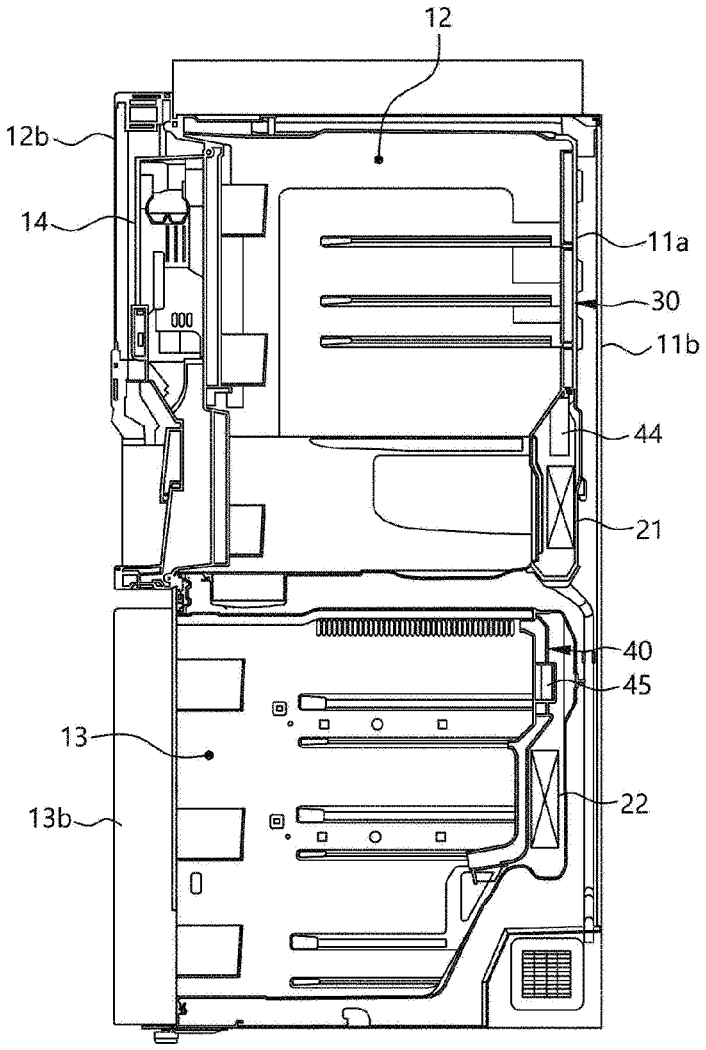

【Figure 27】
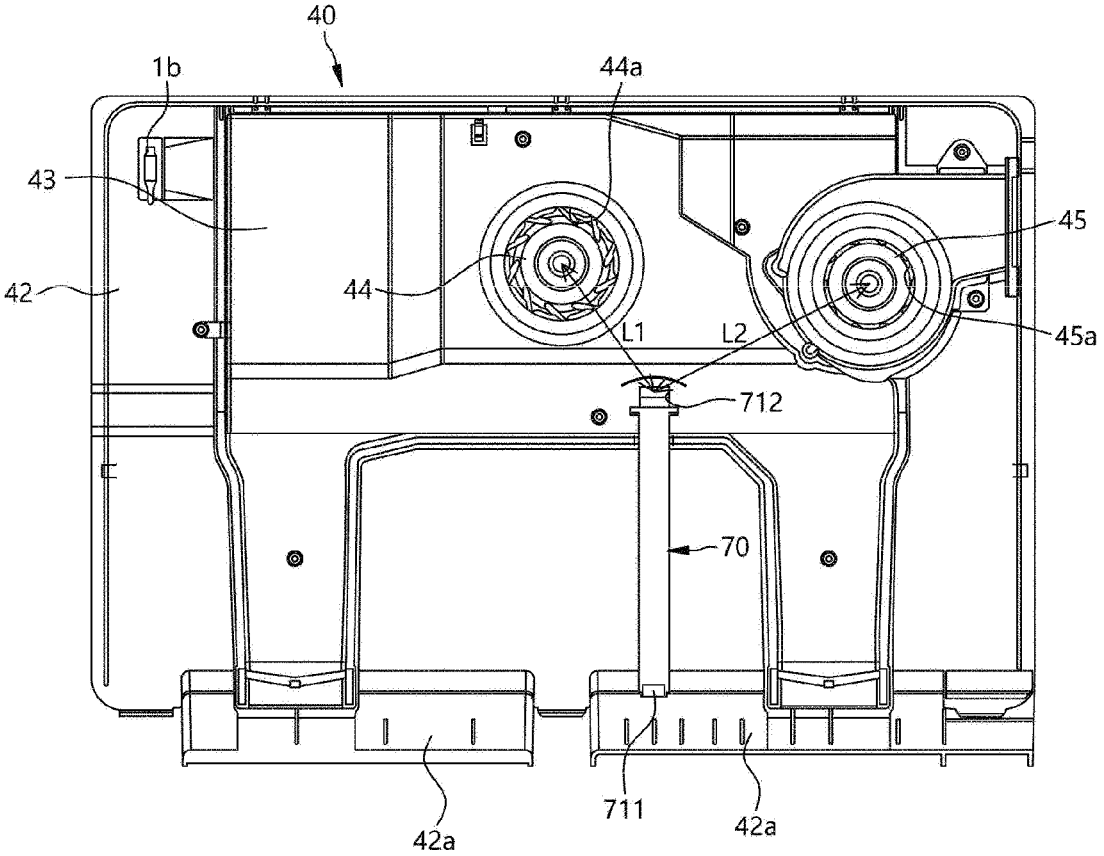
【Figure 28】
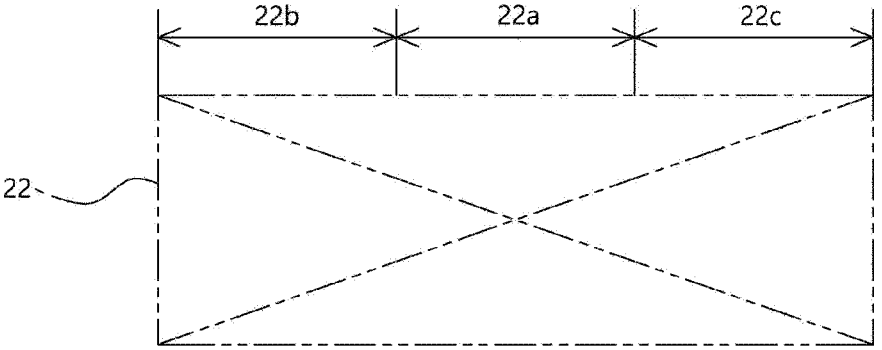

【Figure 29】
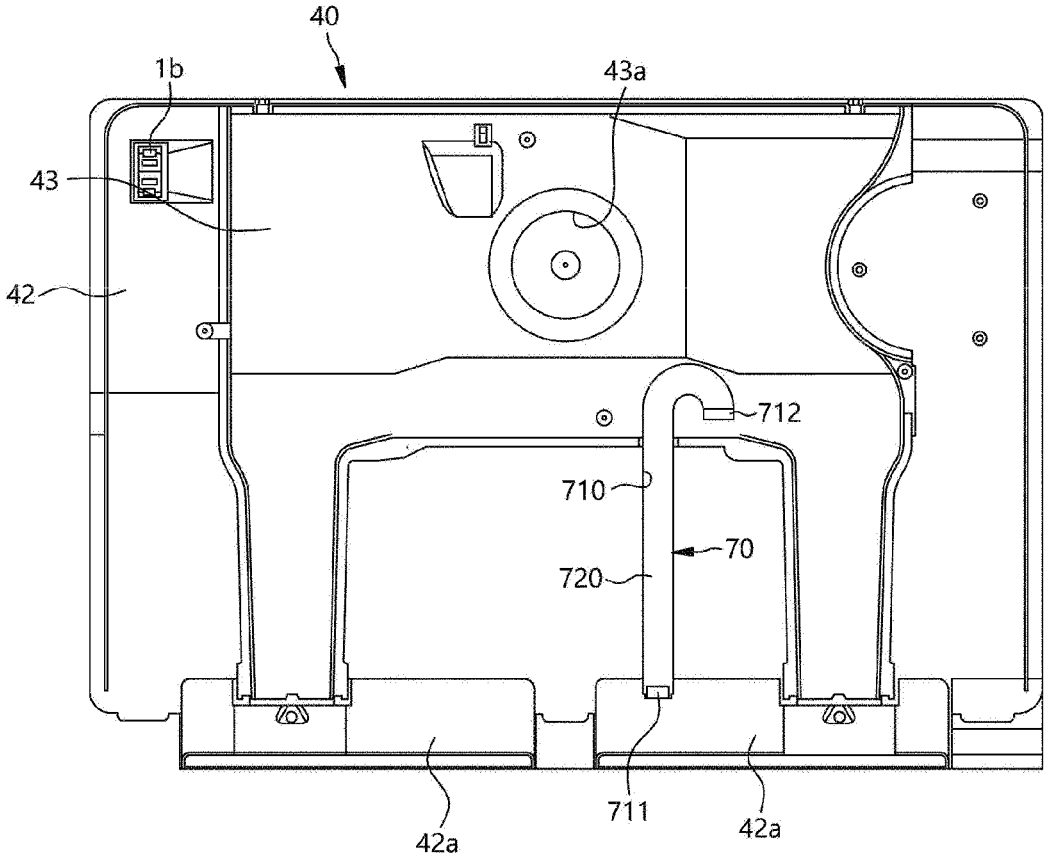

REFRIGERATOR

CROSS-REFERENCE TO PRIOR APPLICATIONS

This application is a National Stage application of PCT/KR2021/009253, filed Jul. 19, 2021, (published on Feb. 10, 2022, as WO 2022/030807 A1), which claims priority to Korean Patent Application No. 10-2020-0098363, filed Aug. 6, 2020, each hereby expressly incorporated by reference in its entirety.

TECHNICAL FIELD

The present disclosure relates to a refrigerator capable of achieving efficiency with respect to a frost detecting device regardless of model or type of a refrigerator by providing an optimum arrangement point of a fluid outlet to detect frosting of a cooling source.

BACKGROUND

In general, a refrigerator is an appliance that uses cold air to store objects in a storage space for a long time or while maintaining at a constant temperature.

The refrigerator includes a refrigeration system including one or more evaporators to generate and circulate the cold air.

Herein, the evaporator serves to maintain internal air of the refrigerator within a preset temperature range by exchanging heat between a low-temperature and low-pressure refrigerant with the internal air of the refrigerator (cold air circulating inside the refrigerator).

Frost is generated on a surface of the evaporator due to water or humidity contained in the internal air of the refrigerator or moisture existing around the evaporator during heat exchange with the internal air of the refrigerator.

Conventionally, when a certain time elapses after the operation of the refrigerator started, a defrosting operation is performed to remove frost generated on the surface of the evaporator.

In other words, conventionally, the defrosting operation is performed through indirect estimation based on the operation time, rather than directly detecting the amount of frost generated on the surface of the evaporator.

Accordingly, conventionally, the defrosting operation is performed even though the frosting is not generated, and thus, there are problems in that power consumption efficiency is reduced or the defrosting operation is not performed despite excessive frosting.

Specifically, the defrosting operation is performed by allowing a heater to emit heat and raise the temperature around the evaporator so that defrosting is performed. After the defrosting operation is performed as described above, a large load operation is performed so that the internal temperature of the refrigerator quickly reaches a preset temperature, resulting in large power consumption.

Accordingly, conventionally, various studies have been made to shorten the time for the defrosting operation or the cycle of the defrosting operation.

In recent years, in order to accurately detect the amount of frosting on the surface of the evaporator, a method using temperature difference or pressure difference between an inlet side and an outlet side of the evaporator has been proposed, and the method was disclosed in Korean Patent Application Publication No. 10-2019-0101669, Korean Patent Application Publication No. 10-2019-0106201, Korean Patent Application Publication No. 10-2019-0106242, Korean Patent Application Publication No. 10-2019-0112482, Korean Patent Application Publication No. 10-2019-0112464, etc.

The above documents describe a bypass flow path, which has a separate flow from an air flow passing through the evaporator, to a cold air duct, and which measures a temperature difference changed in response to a difference of the amount of air passing through the bypass flow path to precisely determine the start time of the defrosting operation.

Meanwhile, it is preferable that an outlet of the bypass flow path is located at a portion that is sufficiently affected by a pressure difference between an air inlet side and an air outlet side of the evaporator but less affected by a flow according to an operation of a blower fan at a freezing compartment.

Accordingly, among the documents above, Korean Patent Application Publication No. 10-2019-0101669 discloses an outlet of the bypass flow path that is located at an outer region of a limited region D3 having a larger diameter than the blower fan. The document proposes that the limited region D3 be 1.5 times or more than a diameter D2 of the blower fan.

However, the limited region D3 is designated without considering the pressure distribution, so the design of a location of the outlet of the bypass flow path is inevitably limited.

In other words, the limited region is preset as a circular region having a predetermined radius based on the blower fan, but the actual pressure distribution has a non-circular shape and a center portion of the pressure distribution does not match with a center portion of the blower fan.

Considering this, when the outlet of the bypass flow path is designed on the basis of the limited region according to the document, a location of the outlet is inevitably designed to be extremely limited, which is a disadvantage.

Specifically, considering that the blower fan is located at the right upper side of the evaporator, a suction pressure acts greater toward a right lower side of the blower fan than other portions.

In the document, there are many restrictions on determining the outlet location because the design is done in which only an effect of flow rate is considered without considering the above-mentioned pressure property.

Furthermore, in a fan duct assembly in which the bypass flow path is formed, not only one blower fan may be provided.

For example, a refrigerator having a structure in which an ice-making compartment is located at a door may additionally have a separate blower fan at the fan duct assembly to supply cold air to the ice-making compartment.

However, the limited region used to determine a location of the outlet of the bypass flow path of the document does not actually consider the effect of another separate blower fan.

Accordingly, the design limit inevitably results in a limited model or shape of a fan duct assembly.

SUMMARY

Accordingly, the present disclosure is made keeping in mind the various problems above, and the present disclosure is intended to provide a refrigerator capable of achieving efficient design with respect to a frost detecting device regardless of model or type of a refrigerator.

One aspect of the present disclosure is to provide a refrigerator capable of maximizing the discrimination of frosting detection by optimizing a location of a fluid outlet of a frosting detection flow path constituting a frost detecting device.

A refrigerator of the present disclosure may have various solutions as follows.

The refrigerator of the present disclosure may be configured such that a distance L from a center portion of a cooling fan to a fluid outlet of a frosting detection flow path is formed farther than a distance from the center portion of the cooling fan to the allowable lowest pressure region A1. Accordingly, an effect of a suction force generated by an operation of the cooling fan does not act excessively, so that discrimination of a measured material property may be secured.

Furthermore, the refrigerator of the present disclosure may be configured such that the distance L from the center portion of a cooling fan to the fluid outlet of the frosting detection flow path is formed closer than a distance from the center portion of the cooling fan to the allowable highest pressure region B1. Accordingly, a pressure difference between the fluid outlet and the fluid inlet of the frosting detection flow path may be provided.

Furthermore, the refrigerator of the present disclosure may be configured such that at least a part of the frosting detection flow path may be disposed between a first duct and a cooling source. Accordingly, a fluid flowing into the first duct and then flowing toward the cooling source may also partially flow into the frosting detection flow path.

Furthermore, the refrigerator of the present disclosure may be configured such that at least a part of the frosting detection flow path may be disposed between a second duct and a storage compartment. Accordingly, the fluid passing through the frosting detection flow path may flow into the storage compartment via the second duct.

Furthermore, in the refrigerator of the present disclosure, a material property measured by a frost detecting device may include at least temperature, pressure, flow amount.

Furthermore, in the refrigerator of the present disclosure, a frosting sensor may include a sensor.

Furthermore, in the refrigerator of the present disclosure, the frosting sensor may include a detecting derivative.

Furthermore, in the refrigerator of the present disclosure, the detecting derivative may include a means that induces improvement of precision when the material property is measured.

Furthermore, in the refrigerator of the present disclosure, the detecting derivative constituting the frost detecting device may include a heating element that emits heat.

Furthermore, in the refrigerator of the present disclosure, a sensor constituting the frost detecting device may include a sensor that measures the temperature of the heat. Accordingly, the frost detecting device may measure a temperature difference value (logic temperature, $\Delta Ht$) according to a flow amount of the fluid.

Furthermore, in the refrigerator of the present disclosure, the cooling source may include at least one of a thermoelectric module or an evaporator.

Furthermore, in the refrigerator of the present disclosure, the thermoelectric module may include a thermoelement.

Furthermore, the refrigerator of the present disclosure may include a refrigerant valve.

Furthermore, the refrigerator of the present disclosure may be configured such that the distance L from the center portion of the cooling fan to the fluid outlet of the frosting detection flow path satisfies a condition of 72 mm≤L≤300 mm. Accordingly, a pressure difference between the fluid inlet and the fluid outlet may exist and a flow rate difference according to whether or not frosting on a second evaporator occurs may exist.

Furthermore, the refrigerator of the present disclosure may be configured such that the distance L from the center portion of the cooling fan to the fluid outlet of the frosting detection flow path satisfies a condition of 72 mm≤L≤200 mm. Accordingly, a flow rate may be accelerated when frosting occurs, and thus a difference in flow rate increases, so that the discrimination in the frosting detection may be improved.

Furthermore, the refrigerator of the present disclosure may be configured such that the distance L from the center portion of the cooling fan to the fluid outlet of the frosting detection flow path satisfies a condition of 72 mm≤L≤115 mm. Accordingly, a flow rate may be further accelerated when frosting occurs, and thus a difference in flow rate further increases, so that the discrimination in the frosting detection may be further improved.

Furthermore, the refrigerator of the present disclosure may be configured such that the distance L from the center portion of the cooling fan to the fluid outlet of the frosting detection flow path satisfies a condition of 115 mm≤L≤300 mm. Accordingly, when frosting insignificantly occurs, a flow rate may be slow, and thus a difference in flow rate increases, so that the discrimination in the frosting detection may be improved.

Furthermore, the refrigerator of the present disclosure may be configured such that the distance L from the center portion of the cooling fan to the fluid outlet of the frosting detection flow path satisfies a condition of 115 mm≤L≤200 mm. Accordingly, when frosting insignificantly occurs, a flow rate may be further slow, and thus a difference in flow rate further increases, so that the discrimination in the frosting detection may be further improved.

In one aspect, the refrigerator of the present disclosure may be configured such that the fluid outlet of the frosting detection flow path may be located between a first fluid inlet for a first fan and a second fluid inlet for a second fan. Accordingly, the fluid outlet may be affected by a pressure according to an operation of the first fan and a pressure according to an operation of the second fan.

Here, the fluid outlet may be disposed between the first fan and the second fan.

The fluid outlet may be disposed between the outside of a radius D1*1.5 of the first fan and the outside of a radius D2*1.5 of the second fan.

Furthermore, the refrigerator of the present disclosure may be configured such that a distance L1 from a center portion of the first fan to the fluid outlet of the frosting detection flow path may be farther than a distance from the center portion of the first fan to an excessive negative pressure region A1 generated by an operation of the first fan, and may be closer than a distance from the center portion of the first fan to a positive pressure region B1 generated by an operation of the first fan.

Furthermore, the refrigerator of the present disclosure may be configured such that a distance L2 from a center portion of the second fan to the fluid outlet of the frosting detection flow path may be farther than a distance to an excessive negative pressure region A2 generated by an operation of the second fan and may be formed closer than a distance to a positive pressure region B2 generated by an operation of the second fan. The A1 may be formed smaller than the A2, and the B1 may be formed smaller than B2.

Furthermore, the refrigerator of the present disclosure may be configured such that the first fluid inlet formed in the second duct for the first fan may be formed larger than the second fluid inlet formed in the second duct for the second fan. Accordingly, the amount of air blowing to a second storage compartment via the first fan may be supplied greater than the amount of air blowing to a third storage compartment via the second fan.

Furthermore, in the refrigerator of the present disclosure, a radius of the first fan and a radius of the second fan may be formed the same. Accordingly, common use of the fan is possible.

Furthermore, the refrigerator of the present disclosure may be configured such that the distance L2 from the center portion of the second fan to the fluid outlet of the frosting detection flow path satisfies a condition of 92 mm≤L2≤320 mm. Accordingly, the material property (flow rate difference or temperature difference) having high discrimination may be secured.

Furthermore, the refrigerator of the present disclosure may be configured such that the distance L2 from the center portion of the second fan to the fluid outlet of the frosting detection flow path satisfies a condition of 92 mm≤L2≤220 mm. Accordingly, when frosting on the second evaporator occurs, a difference in a flow rate may be increased.

Furthermore, the refrigerator of the present disclosure may be configured such that the distance L2 from the center portion of the second fan to the fluid outlet of the frosting detection flow path satisfies a condition of 92 mm≤L2≤135 mm. Accordingly, when frosting on the second evaporator occurs, a difference in a flow rate may be further increased.

Furthermore, the refrigerator of the present disclosure may be configured such that the distance L2 from the center portion of the second fan to the fluid outlet of the frosting detection flow path satisfies a condition of 135 mm≤L2≤320 mm. Accordingly, even when frosting on the second evaporator is insignificant, a flow rate that is sufficient to have the minimum discrimination may be secured.

Furthermore, the refrigerator of the present disclosure may be configured such that the distance L2 from the center portion of the second fan to the fluid outlet of the frosting detection flow path satisfies a condition of 135 mm≤L2≤220 mm. Accordingly, even when frosting on the second evaporator is insignificant, a flow rate that is sufficient to have the excellent minimum discrimination may be secured.

Furthermore, in the refrigerator of the present disclosure, the fluid outlet of the frosting detection flow path may be disposed at a location that does not deviate from opposite ends of the evaporator. Accordingly, frosting on the evaporator may be precisely detected.

Furthermore, in the refrigerator of the present disclosure, the fluid outlet of the frosting detection flow path may be disposed at a location that does not deviate from a center portion of the evaporator. Accordingly, frosting on the evaporator may be further precisely detected.

Furthermore, the refrigerator of the present disclosure may be configured such that a pressure P0 at a location where the fluid outlet of the frosting detection flow path is disposed is preset at a pressure equal to or higher than a region of the allowable lowest pressure P1. Accordingly, an effect of a suction force generated by an operation of the cooling fan does not act excessively, so that discrimination of a measured material property may be secured.

Furthermore, the refrigerator of the present disclosure may be configured such that a pressure P0 at a location where the fluid outlet of the frosting detection flow path is disposed is preset at a pressure lower than or equal to a region of the allowable highest pressure P2. Accordingly, an effect of a suction force generated by an operation of the cooling fan does not act excessively, so that discrimination of a measured material property may be secured.

Furthermore, the refrigerator of the present disclosure may be configured such that the fluid outlet of the frosting detection flow path may be disposed at a location of which the pressure P0 satisfies a condition of −2.6 Pa≤P0<0 Pa. Accordingly, as excessive air suction force is supplied into the frosting detection flow path, it may be prevented that the discrimination of the frosting detection is deteriorated, and air is not suctioned into the frosting detection flow path to prevent the discrimination of the frosting detection from being deteriorated.

Furthermore, the refrigerator of the present disclosure may be configured such that the fluid outlet of the frosting detection flow path may be disposed at a location of which the pressure P0 satisfies a condition of −2.6 Pa≤P0<−1 Pa. Accordingly, as the fluid outlet is located at a negative pressure region lower than the fluid inlet, even when an unexpected external factor is generated, the minimum suction force to the fluid outlet may be provided.

Furthermore, the refrigerator of the present disclosure may be configured such that the fluid outlet of the frosting detection flow path may be disposed at a location of which the pressure P0 satisfies a condition of −2.6 Pa≤P0<−2.1 Pa. Accordingly, as the fluid outlet is located at a negative pressure region lower than the fluid inlet, even when an unexpected external factor is generated, a sufficient suction force to the fluid outlet may be provided.

Furthermore, the refrigerator of the present disclosure may be configured such that the fluid outlet of the frosting detection flow path may be disposed at a location of which the pressure P0 satisfies a condition of −2.1 Pa≤P0<−1 Pa. Accordingly, as the fluid outlet is located at a negative pressure region that is not excessively low, even when an unexpected external factor is generated, the minimum suction force to the fluid outlet may be provided.

Furthermore, the refrigerator of the present disclosure may be configured such that the fluid outlet of the frosting detection flow path may be disposed at a location of which the pressure P0 satisfies a condition of 0 Pa<P0≤1 Pa. Accordingly, even when the fluid outlet is located at the positive pressure region, the fluid outlet is located at a region that is not excessively high, so that an air suction force may be provided to the fluid outlet.

Furthermore, the refrigerator of the present disclosure may be configured such that the fluid outlet of the frosting detection flow path may be disposed at a location of which the pressure P0 satisfies a condition of 0.6 Pa<P0≤1 Pa. Accordingly, even when the fluid outlet is located at the positive pressure region, the fluid outlet is located at a region that is not excessively high, so that the minimum air suction force may be provided to the fluid outlet.

Furthermore, in the refrigerator of the present disclosure, a portion with the fluid outlet of the frosting detection flow path may be bent to be inclined or rounded toward any one side portion among the opposite sides. Accordingly, the fluid outlet may be prevented from being affected by a suction force according to an operation of the cooling fan.

As described above, the refrigerator of the present disclosure has an effect in that considering determination of the optimum location of the fluid outlet can be performed regardless of a model or a type of a refrigerator (or, fan duct assembly) or a location of the fluid outlet may be determined considering other components.

Furthermore, the refrigerator of the present disclosure is configured to provide a location of the fluid outlet considering not only an effect of the pressure distribution generated by an operation of the second cooling fan, but also the pressure difference between the fluid outlet and the fluid inlet of the frosting detection flow path. Therefore, a location of the fluid outlet of the frosting detection flow path may be efficiently designed.

Furthermore, the refrigerator of the present disclosure is configured such that the region provided as the installation location of the fluid outlet is a location that may have the minimum discrimination for the frosting detection. Therefore, the frosting detection may be precisely performed.

DESCRIPTION OF DRAWINGS

FIG. 1 is a front view schematically showing an internal structure of a refrigerator according to an embodiment of the present disclosure.

FIG. 2 is a longitudinal-sectional view schematically showing a structure of the refrigerator according to the embodiment of the present disclosure.

FIG. 3 is a state view schematically showing an operational state performed on the basis of a user set reference temperature with respect to each storage compartment of the refrigerator according to the embodiment of the present disclosure.

FIG. 4 is a view schematically showing a structure of a thermoelectric module according to the embodiment of the present disclosure.

FIG. 5 is a block diagram schematically showing a refrigeration cycle of the refrigerator according to the embodiment of the present disclosure.

FIG. 6 is a main part sectional view showing a space behind a second storage compartment inside a casing in order to describe installation of a frost detecting device and an evaporator that constitute the refrigerator according to the embodiment of the present disclosure.

FIG. 7 is a rear-perspective view of a fan duct assembly used to describe installation of the frost detecting device constituting the refrigerator according to the embodiment of the present disclosure.

FIG. 8 is an exploded-perspective view showing the fan duct assembly without a flow path cover and a sensor of the refrigerator according to the embodiment of the present disclosure.

FIG. 9 is a rear view showing the fan duct assembly used to describe installation of the frost detecting device constituting the refrigerator according to the embodiment of the present disclosure.

FIG. 10 is an enlarged view showing installation of the frost detecting device constituting the refrigerator according to the embodiment of the present disclosure.

FIG. 11 is an enlarged-perspective view showing installation of the frost detecting device constituting the refrigerator according to the embodiment of the present disclosure.

FIG. 12 is a front-perspective view showing the fan duct assembly constituting the refrigerator according to the embodiment of the present disclosure.

FIG. 13 is a view showing a location of a fluid outlet of a frosting detection flow path constituting the refrigerator according to the embodiment of the present disclosure.

FIGS. 14 and 15 are state views each showing a pressure distribution during an operation of a second cooling fan constituting the refrigerator according to the embodiment of the present disclosure.

FIG. 16 is a main part enlarged view showing installation of the frost detecting device according to the embodiment of the present disclosure.

FIG. 17 is a view schematically showing a frosting sensor of the frost detecting device according to the embodiment of the present disclosure.

FIG. 18 is a block diagram schematically showing a control structure of the refrigerator according to the embodiment of the present disclosure.

FIG. 19 is a state graph showing temperature change in the frosting detection flow path in response to on/off of a heating element and on/off of each cooling fan right after defrosting with respect to the evaporator of the refrigerator terminates according to the embodiment of the present disclosure.

FIG. 20 is an enlarged view showing part "A" in FIG. 19.

FIG. 21 is a flowchart showing a control process performed by a controller in an event of frost detecting operation of the refrigerator according to the embodiment of the present disclosure.

FIG. 22 is a state graph showing temperature change in the frosting detection flow path in response to on/off of the heating element and on/off of the cooling fan while frosting to the evaporator of the refrigerator is in progress according to the embodiment of the present disclosure.

FIG. 23 is a perspective view showing a door closed state of the refrigerator according to a second embodiment of the present disclosure.

FIG. 24 is a perspective view showing a door opened state of the refrigerator according to the second embodiment of the present disclosure.

FIG. 25 is a rear-perspective view showing installation of a guide duct provided to supply and recover cold air of the refrigerator according to the second embodiment of the present disclosure.

FIG. 26 is a sectional view showing an internal structure of the refrigerator according to the second embodiment of the present disclosure.

FIG. 27 is a view showing installation of the frosting detection flow path of the refrigerator according to the second embodiment of the present disclosure.

FIG. 28 is a view schematically showing each region with respect to the evaporator of the refrigerator according to the second embodiment of the present disclosure.

FIG. 29 is a view showing installation of the frosting detection flow path of the refrigerator according to a third embodiment of the present disclosure.

DETAILED DESCRIPTION

The present disclosure is provided such that a fluid outlet of a frost detecting device provided for frosting detection is disposed considering pressure distribution around a cooling fan. Accordingly, a design of the frost detecting device may be easily performed and precise frosting detection may be performed.

In other words, the present disclosure provides for achieving an optimized arrangement of the fluid outlet of the frosting detection flow path in consideration of not only a location of fluid inlet with a cooling fan but also pressure distribution generated based on the fluid inlet. Exemplary embodiments with respect to a structure of a refrigerator of the present disclosure and an embodiment of an operation control will be described with reference to FIGS. 1 to 29.

FIG. 1 is a front view schematically showing an internal structure of a refrigerator according to an embodiment of the present disclosure. FIG. 2 is a longitudinal-sectional view schematically showing a structure of the refrigerator according to the embodiment of the present disclosure.

As shown in the drawings, according to the embodiment of the present disclosure, a refrigerator 1 may include a casing 11.

The casing 11 may include an outer casing 11*b* providing an exterior shape of the refrigerator 1.

The casing 11 may include an inner casing 11*a* providing an internal wall surface of the refrigerator 1. A storage compartment may be provided as the inner casing 11*a* to store stored objects.

The storage compartment may include one storage compartment or two or more multiple storage compartments. In the embodiment of the present disclosure, it is illustrated that the storage compartment includes two storage compartments that respectively store stored objects at different temperatures.

The storage compartments may include a first storage compartment 12 maintained at a first set reference temperature.

The first set reference temperature may be a temperature at which stored objects do not freeze and also may be a temperature range lower than an external temperature of the refrigerator 1 (room temperature).

For example, the first set reference temperature may be preset at a temperature that is less than or equal to 32° C. and higher than 0° C. Of course, when necessary (for example, according to the room temperature, a type of stored objects, or the like), the first set reference temperature may be preset more higher than 32° C. or equal to or less than 0° C.

Specifically, the first set reference temperature may be an internal temperature of the first storage compartment 12 preset by a user. However, when the user does not preset the first set reference temperature, an arbitrary designated temperature may be used as the first set reference temperature.

The first storage compartment 12 may be operated at a first operational reference value so as to maintain the first set reference temperature.

The first operational reference value may be preset at a temperature range value including a first lower limit temperature NT−DIFF1. For example, when the internal temperature of the first storage compartment 12 reaches the first lower limit temperature NT−DIFF1 on the basis of the first set reference temperature, an operation for supplying cold air stops.

The first operational reference value may be preset at a temperature range value including a first upper limit temperature NT+DIFF1. For example, when the internal temperature rises on the basis of the first set reference temperature, the operation for cold air supply may be resumed before reaching the first upper limit temperature NT+DIFF1.

As described above, inside the first storage compartment 12, on the basis of the first set reference temperature, the supply of cold air is performed or interrupted in consideration of the first operational reference value with respect to the first storage compartment. This set reference temperature NT and the operational reference value DIFF are as shown in accompanying FIG. 3.

The storage compartment may include a second storage compartment 13 maintained at a second set reference temperature.

The second set reference temperature may be a temperature lower than the first set reference temperature. At this point, the second set reference temperature may be preset by the user, and when the user does not preset the second set reference temperature, an arbitrary preset temperature may be used as the second set reference temperature.

The second set reference temperature may be a temperature at which stored objects can freeze. For example, the second set reference temperature may be preset at a temperature range that is less than or equal to 0° C. and equal to or higher than −24° C. Of course, when necessary (for example, according to the room temperature, a type of stored objects, or the like), the second set reference temperature may be preset higher than 0° C. or less than or equal to −24° C.

Specifically, the second set reference temperature may be an internal temperature of the second storage compartment 13 preset by the user. However, when the user does not preset the second set reference temperature, an arbitrary designated temperature may be used as the second set reference temperature.

The second storage compartment 13 may be configured to be operated at a second operational reference value so as to maintain the second set reference temperature.

The second operational reference value may be preset at a temperature range value including a second lower limit temperature NT−DIFF2. For example, when the internal temperature of the second storage compartment 13 reaches the second lower limit temperature NT−DIFF2 on the basis of the second set reference temperature, an operation for supplying cold air stops.

The second operational reference value may be preset at a temperature range value including a second upper limit temperature NT+DIFF2. For example, when the internal temperature of the second storage compartment 13 rises on the basis of the second set reference temperature, the operation for cold air supply may be resumed before reaching the second upper limit temperature NT+DIFF2.

As described above, inside the second storage compartment 13, on the basis of the second set reference temperature, the supply of cold air is performed or interrupted considering the second operational reference value with respect to the second storage compartment.

The first operational reference value may be preset with a temperature range between the upper limit temperature and the lower limit temperature smaller than the second operational reference value. for example, the second lower limit temperature NT−DIFF2 and the second upper limit temperature NT+DIFF2 of the second operational reference value may be preset to ±2.0° C., and the first lower limit temperature NT−DIFF1 and the first upper limit temperature NT+DIFF1 of the first operational reference value may be preset to ±1.5° C.

Meanwhile, the above-described storage compartment is configured to circulate a fluid and maintain the internal temperature of the storage compartment.

The fluid may be air. Also in the following description, it is illustrated that the fluid circulated in the storage compartment is air. Of course, the fluid may be a gas other than air.

The temperature outside the storage compartment (the room temperature) may be measured by a first temperature sensor 1*a* as shown in FIG. 18, and the internal temperature of the storage compartment may be measured by a second temperature sensor 1*b* (referring to FIG. 9).

The first temperature sensor 1*a* and the second temperature sensor 1*b* may be separately provided. Of course, the room temperature and the internal temperature of the storage compartment may be measured by the same one temperature sensor or be measured by two or more multiple temperature sensors that cooperate.

Furthermore, the storage compartment 12, 13 may include a door 12*b*, 13*b*.

The door 12*b*, 13*b* serves to open and close the storage compartment 12, 13, and may have a rotatable opening and closing structure, or may have a drawer-type opening and closing structure.

The door 12*b*, 13*b* may include one or multiple doors.

Next, according to the embodiment of the present disclosure, the refrigerator 1 includes a cooling source.

The cooling source may include a structure that generates cold air.

The structure that generates cold air of the cooling source may be configured variously.

For example, the cooling source may include a thermoelectric module 23.

As shown in FIG. 4, the thermoelectric module 23 may include a thermoelement 23*a* including an endothermic surface 231 and an exothermic surface 232. The thermoelectric module 23 may comprise of a module including a sink 23*b* connected to at least one of the endothermic surface 231 and the exothermic surface 232 of the thermoelement 23*a*.

As described in the embodiment of the present disclosure, the structure that generates cold air of the cooling source may comprise an evaporator 21, 22.

The evaporator 21, 22 may constitute the refrigerating system together with the compressor 60 (referring to FIG. 5), and serve to perform heat exchange with air passing through the evaporator and lower the temperature of the air.

When the storage compartment includes the first storage compartment 12 and the second storage compartment 13, the evaporator may include a first evaporator 21 and a second evaporator 22, and the first evaporator 21 may supply cold air to the first storage compartment 12 and the second evaporator 22 may supply cold air to the second storage compartment 13.

At this point, inside the inside space of the inner casing 11*a*, the first evaporator 21 may be located at a rear side in the first storage compartment 12, and the second evaporator 22 may be located at a rear side in the second storage compartment 13.

Of course, although not shown in the drawing, one evaporator may be provided only in at least one of the first storage compartment 12 and the second storage compartment 13.

Even when two evaporators are provided, the one compressor 60 constituting the refrigerating cycle may be provided. In this case, as shown in FIG. 5, the compressor 60 may be connected to the first evaporator 21 so as to supply a refrigerant via a first refrigerant path 61, and may be connected to the second evaporator 22 so as to supply the refrigerant via a second refrigerant path 62. At this point, the refrigerant path 61, 62 may be selectively opened and closed using a refrigerant valve 63.

The refrigerator may include a structure that supplies the generated cold air to the storage compartment.

The cooling fan may be included as the structure that supplies the cold air of the cooling source. The cooling fan may serve to supply the cold air into the storage compartment 12, 13, the cold air being generated while passing through the cooling source.

At this point, the cooling fan may include a first cooling fan 31 that supplies the cold air generated while passing through the first evaporator 21, into the first storage compartment 12.

The cooling fan may include a second cooling fan 41 that supplies the cold air generated while passing through the second evaporator 22, into the second storage compartment 13.

Next, according to the embodiment of the present disclosure, the refrigerator 1 may include a first duct.

The first duct may be formed of at least one of a passage through which air passes (e.g., tube such as duct, pipe, or the like), a hole, and an air flow path. Air may flow from the inside space of the storage compartment to the cooling source by guidance of the first duct.

With reference to FIG. 6, the first duct may include an inlet duct 42*a*. In other words, a fluid flowing in the second storage compartment 13 by guidance of the inlet duct 42*a* may flow into the second evaporator 22.

The first duct may include a part of a bottom surface of the inner casing 11*a*. At this point, a part of the bottom surface of the inner casing 11*a* is a portion that is from a portion facing the bottom surface of the inlet duct 42*a* to a position to which the second evaporator 22 is mounted. Therefore, the first duct provides a flow path through which a fluid flows from the inlet duct 42*a* toward the second evaporator 22.

Next, according to the embodiment of the present disclosure, the refrigerator 1 may include the second duct.

The second duct may be formed of at least one of a passage that guides air around the evaporator 21, 22 so that the air flows into the storage compartment (e.g., tube such as duct, pipe, or the like), a hole, and a flow path of air.

The second duct may include a fan duct assembly 30, 40 that is located at front of the evaporator 21, 22.

As shown in FIGS. 1 and 2, the fan duct assembly 30, 40 may include at least one of a first fan duct assembly 30 and a second fan duct assembly 40, and the first fan duct assembly 30 guides cold air so that the cold air flows into the first storage compartment 12, and the second fan duct assembly 40 guides cold air so that the cold air flows into the second storage compartment 13.

At this point, a space between the fan duct assembly 30, 40 of the inside space of the inner casing 11*a* where the evaporator 21, 22 is located and a rear wall surface of the inner casing 11*a* may be defined as a heat-exchange flow path where air exchanges heat with the evaporator 21, 22.

Of course, although not shown in the drawings, even when a evaporator is provided only at one of the storage compartment, the fan duct assembly 30, 40 may be provided for each storage compartment 12, 13. And even when the evaporator 21, 22 is provided to each storage compartment 12, 13, only one fan duct assembly 30, 40 may be provided. Various configurations are possible.

Meanwhile, in the embodiment described below, it is illustrated that a structure that generates cold air of the cooling source is the second evaporator 22, and a structure that supplies the cold air of the cooling source is the second cooling fan 41, and the first duct is the inlet duct 42*a* formed in the second fan duct assembly 40, and the second duct is the second fan duct assembly 40.

As shown in FIGS. 7 to 9, the second fan duct assembly 40 may include a fan grille 42.

At this point, the inlet duct 42*a* may be formed in the fan grille 42 to suction air from the second storage compartment 13.

The inlet duct 42*a* may be formed at each of opposite ends of a lower portion of the fan grille 42, and is configured to guide a suctioned flow of air that flows along an inclined corner portion, which is inclined due to a machine chamber, between a bottom surface and the rear wall surface in the inner casing 11*a*.

At this point, the inlet duct 42*a* may be used as a partial structure of the above-described first duct. In other words, the inlet duct 42*a* allows a fluid inside the second storage compartment 13 to flow into the cooling source (second evaporator 22).

Furthermore, as shown in FIGS. 7 to 9, the second fan duct assembly 40 may include a shroud 43.

The shroud 43 may be coupled to a rear surface of the fan grille 42. Accordingly, a flow path for guiding a flow of cold air into the second storage compartment 13 may be provided between the shroud 43 and the fan grille 42.

A fluid inlet 43*a* may be formed on the shroud 43. In other words, cold air passing through the second evaporator 22 flows into the flow path between the fan grille 42 and the shroud 43 via the fluid inlet 43*a*, and then passes through each cold air outlet 42*b* of the fan grille 42 by guidance of the flow path, so that the cold air is discharged to the second storage compartment 13.

The cold air outlet 42*b* may include two or more multiple cold air outlets 42*b*. For example, as shown in FIGS. 9 and 12, the cold air outlets 42*b* may be respectively formed at opposite side portions of an upper portion, opposite side portions of an intermediate portion, and opposite side portions of a lower portion of the fan grille 42.

The second evaporator 22 is provided to be located at a lower position than the fluid inlet 43*a* (referring to FIG. 9).

Meanwhile, the second cooling fan 41 may be installed in the flow path between the fan grille 42 and the shroud 43.

Preferably, the second cooling fan 41 may be installed in the fluid inlet 43*a* formed in the shroud 43. In other words, by operation of the second cooling fan 41, air inside the second storage compartment 13 may pass successively through the inlet duct 42*a* and the second evaporator 22 and then may flow into the flow path via the fluid inlet 43*a*.

Next, according to the embodiment of the present disclosure, the refrigerator 1 may include a frost detecting device 70.

The frost detecting device 70 is a device that detects the amount of frost or ice generated on the cooling source.

FIG. 6 is a main part sectional view showing an installed state of the frost detecting device and the evaporator according to the embodiment of the present disclosure. FIGS. 7 to 11 are views showing installed state of the frost detecting device in the second fan duct assembly.

As in the embodiment shown in the drawings, the frost detecting device of according to the embodiment of the present disclosure is a divide that is located on a flow path of a fluid guided to the second fan duct assembly 40 and detects frosting of the second evaporator 22.

Furthermore, the frost detecting device 70 may recognize a degree of frosting of the second evaporator 22 by using a sensor outputting different values in response to a fluid property. At this point, the fluid property may include at least one of temperature, pressure, and flow amount.

The frost detecting device 70 may be configured to precisely determine the execution time of defrosting operation on the basis of the degree of frosting recognized as described above.

As shown in FIG. 8, the frost detecting device 70 may include a frosting detection flow path 710.

The frosting detection flow path 710 may provide a flow passage (flow path) of air detected by a frosting sensor 740 in order to detect frosting of the second evaporator 22. The frosting detection flow path 710 may be provided as a portion where a frosting sensor 730 to detect frosting of the second evaporator 22 is located.

Specifically, at least a part of the frosting detection flow path 710 may be configured as a flow path that is divided from a flow of air passing through the second evaporator 22 and a flow of air flowing in the second fan duct assembly 40.

At least a part of the frosting detection flow path 710 may be located at least at any one portion in a flow path of cold air circulated in the second storage compartment 13, the inlet duct 42*a*, the second evaporator 22, and the second fan duct assembly 40.

Preferably, at least a part of the frosting detection flow path 710 may be arranged at an inlet flow path through which a fluid flows toward the cooling source while passing through the first duct.

For example, a fluid inlet 711 of the frosting detection flow path 710 may be disposed on a flow path formed between the inlet duct (first duct) 42*a* and the second evaporator (cooling source) 22.

Furthermore, the frosting detection flow path 710 may be formed by recessing a facing surface to a surface of the fan grille 42 constituting the second fan duct assembly 40, the surface facing the second evaporator 22, thereby allowing air to flow into the frosting detection flow path 710.

The frosting detection flow path 710 may be formed to protrude forward of the grille fan 42, as shown in FIG. 7.

Of course, although not shown in the drawings, the frosting detection flow path 710 may be made into a separate tubular body from the fan grille 42, and the frosting detection flow path 710 may be fixed (attached or coupled) to the fan grille 42 or formed in or coupled to the shroud 43.

The frosting detection flow path 710 may be formed to be opened at a rear portion thereof facing the second evaporator 22, and in the opened rear portion, portions except for the fluid inlet 711 and a fluid outlet 712 may be configured to be closed by a flow path cover 720.

The fluid inlet 711 of the frosting detection flow path 710 may be located between the inlet duct 42*a* and an air inlet side of the second evaporator 22.

In other words, some of the air suctioned into the air inlet side of the second evaporator 22 through the inlet duct 42*a* may flow into the frosting detection flow path 710.

Furthermore, at least a part of the frosting detection flow path 710 may be disposed in a flow path formed between the second duct (the second fan duct assembly) and the second storage compartment 13.

Preferably, the fluid outlet 712 of the frosting detection flow path 710 may be located between an air outlet side of the second evaporator 22 and a flow path through which cold air is supplied to the second storage compartment 13.

The fluid outlet 712 of the frosting detection flow path 710 may be located between the fluid inlet 43*a* of the shroud 43 and an air outlet side of the second evaporator 22. In other words, air that passed through the frosting detection flow path 710 may directly flow between the air outlet side of the second evaporator 22 and the fluid inlet 43*a* of the shroud 43.

Meanwhile, as the amount of frosting on the second evaporator 22 increases and an air flow passing through the second evaporator 22 is gradually blocked, a pressure difference between the air inlet side and the air outlet side of the second evaporator 22 gradually becomes larger. The amount of air suctioned into the frosting detection flow path 710 gradually increases by the pressure difference.

As the amount of air suctioned into the frosting detection flow path 710 becomes larger, the temperature of a heating element 731 constituting the frosting sensor 730 described below falls, and a temperature difference value $\Delta Ht$ in on/off of the heating element 731 (hereinbelow, which is referred to as "logic temperature") falls.

Considering this, as the logic temperature ΔHt inside the frosting detection flow path 710 becomes lower, the logic temperature being detected by the frosting sensor 730, detects the increase in the amount of frosting on the second evaporator 22.

When there is no frost at the second evaporator 22 or a frosting amount is significantly less, most air passes through the second evaporator 22 in the heat-exchange space. On the other hand, some of the air may flow into the frosting detection flow path 710.

For example, based on a state in which frosting does not occur on the second evaporator 22, the frosting detection flow path 710 may be configured such that about 98% of the air suctioned via the inlet duct 42*a* passes through the second evaporator 22 and remaining air passes through the frosting detection flow path 710.

At this point, the amount of air passing through the second evaporator 22 and the frosting detection flow path 710 may gradually vary in response to the amount of frosting on the second evaporator 22.

For example, when frost is generated on the second evaporator 22, the amount of air passing through the second evaporator 22 is reduced. On the other hand, the amount of air passing through the frosting detection flow path 710 is increased.

In other words, compared to the amount of air passing through the frosting detection flow path 710 before the frosting of the second evaporator 22, the amount of air passing through the frosting detection flow path 710 in the frosting of the second evaporator 22 significantly increases.

Specifically, it is desirable to configure the frosting detection flow path 710 such that the change in the amount of air according to the amount of frosting on the second evaporator 22 can be at least doubled. In other words, in order to determine the amount of frosting using the amount of air, the amount of air should be generated by at least two times or more to obtain a detection value sufficient to have discrimination.

When the amount of frosting of the second evaporator 22 is large enough to require the defrosting operation, frost on the second evaporator 22 acts as a resistance in the flow path, so that the amount of the air flowing in the heat-exchange space of the evaporator 22 is reduced and the amount of the air flowing in the frosting detection flow path 710 is increased.

As described above, the flow amount of the air flowing in the frosting detection flow path 710 varies according to the amount of frosting on the second evaporator 22.

Furthermore, a flow rate of air flowing in the frosting detection flow path 710 may vary in response to a distance L from a center portion (or center of fluid inlet) of the second cooling fan 41 to the fluid outlet 712.

In other words, it is preferable that the distance L from the center portion of the second cooling fan 41 to the fluid outlet 712 is set to be greater than a distance from the center portion of the second cooling fan 41 to an allowable lowest pressure region A1 among a pressure region generated by an operation of the second cooling fan 41, and to be smaller than a distance from the center portion of the cooling fan 41 to an allowable highest pressure region B1 among the pressure region generated by an operation of the cooling fan 41.

The distance to a location of the allowable lowest pressure region A1 may be within a region existing at a distance of 72 mm or more and 115 mm or less from a center portion of a first fan 44.

The distance to a location of the allowable highest pressure region B1 may be within a region existing at a distance of 200 mm or more and 300 mm or less from the first fan 44.

Preferably, the distance L from the center portion of the second cooling fan 41 to the fluid outlet of the frosting detection flow path 710 may satisfy a condition of 72 mm≤L≤300 mm. At this point, when the distance L from the center portion of the second cooling fan 41 to the fluid outlet 712 of the frosting detection flow path 710 is longer than 300 mm, there is a fine pressure difference between the fluid inlet 711 and the fluid outlet 712, and when the distance L is closer than 72 mm, under the effect of the suctioning force caused by an operation of the second cooling fan 41, there is a fine difference in a flow rate in response to whether or not frost is generated on the second evaporator 22.

In other words, only when the fluid outlet 712 is located at a distance greater than a preset reference value or more from the center portion of the second cooling fan 41, the effect (flow rate, flow amount) of the second cooling fan 41 on the fluid outlet 712 of the frosting detection flow path 710 may be reduced.

Furthermore, through the above-described reduction of the effect, a pressure difference between the fluid inlet 711 and the fluid outlet 712 of the frosting detection flow path 710 may relatively increase, and as the pressure difference increases, differences of the flow rate and flow amount between the fluid inlet 711 and the fluid outlet 712 of the frosting detection flow path 710 may increase.

Accordingly, sensing precision of the frost detecting device 70 according to the embodiment of the present disclosure may be improved.

Of course, the distance L from the center portion of the second cooling fan 41 to the fluid outlet 712 of the frosting detection flow path 710 may satisfy a condition of 72 mm≤L≤200 mm. In this case, a flow rate when frosting occurs may be accelerated, and thus a difference in flow rate increases, so that the discrimination in the frosting detection may be improved.

The distance L from the center portion of the second cooling fan 41 to the fluid outlet 712 of the frosting detection flow path 710 may satisfy a condition of 72 mm≤L≤115 mm. In this case, a flow rate when frosting occurs may be further accelerated, and thus a difference in flow rate further increases, so that the discrimination in the frosting detection may be further improved.

The distance L from the center portion of the second cooling fan 41 to the fluid outlet 712 of the frosting detection flow path 710 may satisfy a condition of 115 mm≤L≤300 mm. In this case, a flow rate when frosting insignificantly occurs may be slow, and thus a difference in flow rate increases, so that the discrimination in the frosting detection may be improved.

The distance L from the center portion of the second cooling fan 41 to the fluid outlet 712 of the frosting detection flow path 710 may satisfy a condition of 115 mm≤L≤200 mm. In this case, a flow rate when frosting insignificantly occurs may be further slow, and thus a difference in flow rate further increases, so that the discrimination in the frosting detection may be further improved.

Meanwhile, the flow amount of air flowing through the frosting detection flow path 710 may vary in response to a pressure of a portion where the fluid outlet 712 is located.

In other words, when the amount of frosting on the second evaporator 22 is small, there is an insignificant pressure difference between the fluid outlet 712 and the fluid inlet 711, but when the amount of frosting on the second evaporator 22 is large, when a pressure difference between the fluid outlet 712 and the fluid inlet 711 increases, the discrimination in the frosting detection may be improved.

Considering this, it is preferable that the fluid outlet 712 of the frosting detection flow path 710 is located in a region that has a distribution of a pressure P0 that is equal to or higher than an allowable lowest pressure P1 and less than or equal to a highest pressure P2 during an operation of the second cooling fan 41.

At this point, it is preferable that the lowest pressure P1 has a pressure range of a negative pressure (pressure lower than at atmospheric pressure), and it is preferable that the highest pressure P2 has a pressure range higher than the lowest pressure P1.

Preferably, the fluid outlet 712 of the frosting detection flow path 710 may be disposed in a location in which the pressure P0 satisfies a condition of −2.6 Pa≤P0<0 Pa. In other words, the fluid outlet 712 may be located in the negative pressure region and may be located in the region having the range where a pressure is equal to or higher than −2.6 Pa.

At this point, when the fluid outlet 712 is located in a pressure region less than −2.6 Pa, even when frosting insignificantly occurs on the second evaporator 22, excessive air suctioning force is supplied, and thus a temperature difference in response to whether or not frosting occurs is small so that the discrimination in the frosting detection may be deteriorated.

Of course, the fluid outlet 712 of the frosting detection flow path 710 may be disposed in a location in which the pressure P0 satisfies a condition of −2.6 Pa≤P0≤−1 Pa. In other words, the fluid outlet 712 is located in a lower negative pressure region, so that it is preferable that the minimum air suctioning force is supplied to the fluid outlet 712 even when an unexpected external factor occurs.

The fluid outlet 712 of the frosting detection flow path 710 may be disposed in a location of which the pressure P0 satisfies a condition of −2.6 Pa≤P0≤2.1 Pa. In other words, the fluid outlet 712 is located in a lower negative pressure region, so that a sufficient air suctioning force is supplied to the fluid outlet 712 even when an unexpected external factor occurs.

The fluid outlet 712 of the frosting detection flow path 710 may be disposed in a location in which the pressure P0 satisfies a condition of −2.1 Pa≤P0≤−1 Pa. In other words, the fluid outlet 712 is located in a negative pressure region that is not excessively low, so that the minimum air suctioning force is supplied to the fluid outlet 712 even when an unexpected external factor occurs.

Preferably, the fluid outlet 712 of the frosting detection flow path 710 may be disposed in a location of which the pressure P0 satisfies a condition of −1 Pa≤P0<0 Pa. In other words, it is preferable that the fluid outlet 712 is located in the negative pressure region without excessive application of the air suctioning force caused by the second cooling fan 41, so that the minimum amount of the air suctioning force may be supplied even in non-frosting state of the second evaporator 22.

Specifically, the pressure region of −2.6 Pa or less to be avoided is not formed in a circular shape from the second cooling fan 41, but has a shape that is focused on a lower portion of the second cooling fan 41 with an upper external circumferential surface of the second cooling fan 41 as a peak. The shape is as shown in FIGS. 14 and 15.

Considering this, it may be preferable that the fluid outlet 712 of the frosting detection flow path is located at a side portion of or above the second cooling fan 41 even within 1.5 times of the diameter of the fluid inlet 43*a* from the center portion of the second cooling fan 41, in comparison with the fluid outlet 712 being located below the second cooling fan 41 even over 1.5 times of the diameter of the fluid inlet 43*a* from the center portion of the second cooling fan 41.

Meanwhile, the fluid outlet 712 of the frosting detection flow path 710 may be located in a region having a positive pressure.

For example, the fluid outlet 712 of the frosting detection flow path 710 may be disposed in a location of which the pressure P0 satisfies a condition of 0 Pa<P0≤1 Pa. In other words, even when the fluid outlet 712 is located in the positive pressure region, the fluid outlet 712 is located in a region that is not excessively high so that the air suctioning force may be supplied to the fluid outlet 712.

The fluid outlet 712 of the frosting detection flow path 710 may be disposed in a location in which the pressure P0 satisfies a condition of 0.6 Pa≤P0≤1 Pa. In other words, even when the fluid outlet 712 is located in the positive pressure region, the fluid outlet 712 is located in a region that is not excessively high so that the minimum air suctioning force may be supplied to the fluid outlet 712.

As described above, the fluid outlet 712 provided by the frosting detection flow path 710 is set on the basis of the actual pressure distribution of the portion where the second cooling fan 41 is located, and not on an outer diameter (radius) of the second cooling fan 41.

Accordingly, a location of the fluid outlet 712 provided by the frosting detection flow path 710 of the present disclosure may be disposed in various locations that is more than the related art, and design changes may be easily performed for other components (or shapes) in consideration of the locations to be arranged.

The location of the fluid outlet 712 may be designed, as described above, considering only the distance L from the center portion of the second cooling fan 41 to the fluid outlet 712 of the frosting detection flow path 710, and may be designed considering only the pressure P0 at the portion where the fluid outlet 712 of the frosting detection flow path 710 is located.

However, it is preferable that the location of the fluid outlet 712 is designed considering both of the distance L and the pressure P0 at the same time.

Furthermore, the frost detecting device 70 may include the frosting sensor 730.

The frosting sensor 730 is a sensor that detects a material property of a fluid passing through inside of the frosting detection flow path 710. At this point, the fluid property may include at least one of temperature, pressure, and flow amount.

Specifically, the frosting sensor 730 may be configured to calculate the amount of frosting on the second evaporator 22 on the basis of a difference in an output value that is changed according to the material property of the air (fluid) passing through inside the frosting detection flow path 710.

In other words, the amount of frosting on the second evaporator 22 is calculated by a difference in the output value detected by the frosting sensor 730 to be used to determine whether the defrosting operation is required.

In the embodiment of the present disclosure, it is illustrated that the frosting sensor 730 is provided to detect the amount of frosting on the second evaporator 22 by using a difference in temperature according to the amount of the air passing through inside the frosting detection flow path 710.

In other words, as shown in FIG. 16, the frosting sensor 730 is provided at a portion where a fluid flows, inside the frosting detection flow path 710, so that the amount of frosting on the second evaporator 22 may be detected on the basis of the output value that changes according to a fluid flow inside the frosting detection flow path 710.

Of course, the output value may be variously determined as not only the above-described temperature difference, but also a pressure difference, other property difference, or the like.

As shown in FIG. 17, the frosting sensor 730 may include a detecting derivative.

The detecting derivative may provide for induced improvement of measurement precision so that the sensor may further precisely measure a material property (or output value).

In the embodiment of the present disclosure, it is illustrated that the detecting derivative includes the heating element 731.

The heating element 731 is supplied with power and emits heat.

As shown in FIG. 17, the frosting sensor 730 may include a temperature sensor 732.

The temperature sensor 732 measures the temperature around the heating element 731.

In other words, considering that the temperature around the heating element 731 varies according to the amount of the air passing through the heating element 731 while passing through inside the frosting detection flow path 710, the temperature sensor 732 measures a change in temperature, and then the degree of frosting of the second evaporator 22 is calculated on the basis of the change in temperature.

As shown in FIG. 17, according to the embodiment of the present disclosure, the frosting sensor 730 may include a sensor printed circuit board (PCB) 733.

The sensor PCB 733 is configured to determine a difference between the temperature detected by the temperature sensor 732 in an OFF state of the heating element and the temperature detected by the temperature sensor 732 in an ON state of the heating element 731.

Of course, the sensor PCB 733 may be configured to determine whether the logic temperature ΔHt is less than or equal to a reference difference value.

For example, when the amount of frosting on the second evaporator 22 is less, a flow amount of the air passing through inside the frosting detection flow path 710 is less, and in this case, heat generated due to the heat state of the heating element 731 is cooled relatively low by the above-described flowing air.

Accordingly, the temperature detected by the temperature sensor 732 is high, and the logic temperature ΔHt is also high.

On the other hand, when the amount of frosting on the second evaporator 22 is large, a flow amount of the air passing through inside the frosting detection flow path 710 is large, and in this case, heat generated due to the ON state of the heating element 731 is cooled relatively more by the above-described flowing air.

Accordingly, the temperature detected by the temperature sensor 732 is low, and the logic temperature ΔHt is also low.

Therefore, the amount of frosting on the second evaporator 22 may be precisely determined according to high or low of the logic temperature ΔHt, and on the basis of the amount of frosting on the second evaporator 22 determined as described above, the defrosting operation may be performed at the precise time.

In other words, when the logic temperature ΔHt is high, it is determined that the amount of frosting on the second evaporator 22 is small, and when the logic temperature ΔHt is low, it is determined that the amount of frosting on the second evaporator 22 is large.

Accordingly, the reference temperature difference value is designated, and when the logic temperature ΔHt is lower than the designated reference temperature difference value, it may be determined that the defrosting operation of the second evaporator 22 is required.

Meanwhile, the frosting sensor 730 is installed in a direction that crosses a direction of air passing through inside the frosting detection flow path 710, and a surface of the frosting sensor 730 and an inner surface of the frosting detection flow path 710 are located to be spaced apart from each other.

In other words, water may flow down through a gap between the frosting sensor 730 and the frosting detection flow path 710 that are spaced apart from each other.

At this point, a distance of the gap is preferably formed sufficient to prevent water from staying between the surface of the frosting sensor 730 and the inner surface of the frosting detection flow path 710.

It is preferable that the heating element 731 and the temperature sensor 732 may be located together on any one surface of the frosting sensor 730.

In other words, the heating element 731 and the temperature sensor 732 are located on the same surface, so that the temperature sensor 732 may precisely sense the change in temperature due to heat-emission of the heating element 731.

Furthermore, the frosting sensor 730 may be disposed between a fluid inlet 711 and a fluid outlet 712 of the frosting detection flow path 710, inside the frosting detection flow path 710.

Preferably, the frosting sensor 730 may be disposed at a position spaced apart from the fluid inlet 711 and the fluid outlet 712.

For example, the frosting sensor 730 may be disposed at an intermediate position inside the frosting detection flow path 710. The frosting sensor 730 may be disposed at a position inside the frosting detection flow path 710 relatively close to the fluid inlet 711 than the fluid outlet 712. Or the frosting sensor 730 may be disposed at a position inside the frosting detection flow path 710 relatively closer to the fluid outlet 712 than the fluid inlet 711.

Furthermore, the frosting sensor 730 may include a sensor housing 734.

The sensor housing 734 serves to prevent the water flowing down along the inside of the frosting detection flow path 710 from being brought into contact with the heating element, the temperature sensor 732, or the sensor PCB 733.

The sensor housing 734 may be formed such that any one of opposite ends thereof is open. Accordingly, a power wire (or signal wire) may be taken out of the sensor PCB 733.

Next, according to the embodiment of the present disclosure, the refrigerator 1 may include a defrosting device 50.

The defrosting device 50 is configured to provide a heat source to remove frost generated on the second evaporator 22.

As shown in FIG. 6, the defrosting device 50 may include a first heater 51.

In other words, frost generated on the second evaporator 22 may be removed by heat-emission of the first heater 51.

The first heater 51 may be located at a lower portion of the second evaporator 22. In other words, the first heater 51 is configured such that heat may be supplied in the air flowing direction from a lower end of the second evaporator 22 to an upper end thereof.

Of course, although not shown in the drawing, the first heater 51 may be located at a lateral portion of the second evaporator 22, may be located at a front portion or a rear portion of the second evaporator 22, may be located at an upper portion of the second evaporator 22, or may be located to be brought into contact with the second evaporator 22.

The first heater 51 may comprise of a sheath heater. In other words, the first heater 51 may be configured such that frost generated on the second evaporator 22 is removed by using radiant heat and convective heat of the sheath heater.

Furthermore, as shown in FIG. 6, the defrosting device 50 may include a second heater 52.

The second heater 52 may emit heat at a lower output than the first heater 51 and supply the heat to the second evaporator 22.

The second heater 52 may be located to be in contact with the second evaporator 22. In other words, the second heater 52 is configured to remove frost generated on the second evaporator 22 by heat conduction while being directly in contact with the second evaporator 22.

The second heater 52 may comprise of an L-cord heater. In other words, the second heater is configured to remove frost generated on the second evaporator 22 by conductive heat of the L-cord heater.

At this point, the second heater 52 may be installed to be successively in contact with a heat-exchange fin located in each layer of the second evaporator 22.

The heater included in the defrosting device 50 may include both of the first heater 51 and the second heater 52, or may include only the first heater 51, or include only the second heater 52.

Meanwhile, the defrosting device 50 may include an evaporator temperature sensor.

The evaporator temperature sensor may detect the temperature around the defrosting device 50, and the detected temperature value may be used as a factor that determines ON/OFF of the heater 51, 52.

As an example, after the heater 51, 52 is turned ON, when the temperature value detected by the evaporator temperature sensor reaches a specific temperature (defrosting termination temperature), the heater 51, 52 may be turned OFF.

The defrosting termination temperature may be preset as an initial temperature, and when remaining ice is detected on the second evaporator 22, the defrosting termination temperature may be raised by a predetermined temperature.

Next, according to the embodiment of the present disclosure, the refrigerator 1 may include a controller 80.

As shown in FIG. 18, the controller 80 may be a device that controls operation of the refrigerator 1, such as a microprocessor, an electrical logic circuit, etc.

For example, when the internal temperature of each storage compartment 12, 13 is within the dissatisfaction temperature region that is divided on the basis of the set reference temperature NT preset for the storage compartment by the user, the controller 80 controls the amount of cold air supply to increase so that the internal temperature of the storage compartment may fall, and when the internal temperature of the storage compartment is within the satisfaction temperature region that is divided on the basis of the set reference temperature NT, the controller 80 may control the amount of cold air supply to be reduced.

Furthermore, the controller 80 may control the frost detecting device 70 to perform frost detecting operation.

To this end, the controller 80 may perform the frost detecting operation for a preset frost detecting time.

The frosting detecting time may be controlled to vary depending on a temperature value of the room temperature measured by the first temperature sensor 1*a*, or the temperature preset by the user.

For example, as the room temperature becomes higher, the frost detecting time may be controlled to be performed at short intervals due to more frequent cooling operation, and as the room temperature becomes lower, the frost detecting time may be controlled to be performed at sufficiently long intervals due to fewer cooling operations.

Furthermore, the controller 80 controls the frosting sensor 730 to be operated for a predetermined cycle.

In other words, the heating element 731 of the frosting sensor 730 emits heat for a predetermined time by control of the controller 80, and the temperature sensor 732 of the frosting sensor 730 detects the temperature directly after the heating element 731 is turned ON and detects the temperature directly after the heating element 731 is turned OFF.

Therefore, after the heating element 731 is turned ON, the lowest temperature and the highest temperature may be detected and a temperature difference value between the lowest temperature and the highest temperature may be maximized, so that discrimination for frosting detection may be more enhanced.

Furthermore, the controller 80 may detect a temperature difference value (logic temperature ΔHt) when the heating element 731 is turned ON and OFF, and may determine whether the maximum value of the logic temperature ΔHt is less than or equal to a first reference difference value.

At this point, the first reference difference value may be preset as a value sufficient as not to operate the defrosting operation.

Of course, the sensor PCB 733 constituting the frosting sensor 730 may be configured to perform detecting the logic temperature ΔHt and comparing the logic temperature to the first reference difference value.

In this case, the controller 80 may be configured to receive the detection of the logic temperature ΔHt and the comparison result value with the first reference difference value that are performed by the sensor PCB 733 to control ON/OFF of the heating element 731.

Next, according to the embodiment of the present disclosure, the frost detecting operation provided to detect the amount of frosting with respect to the second evaporator 22 of the refrigerator 1 will be described.

FIG. 21 is a flowchart showing a control process in which the defrosting operation is performed by determining a defrosting requirement time of the refrigerator according to the embodiment of the present disclosure. FIGS. 19 and 22 are state graphs showing change in the temperature that is measured by the frosting sensor before and after frosting of the second evaporator according to the embodiment of the present disclosure.

FIG. 19 is a state graph showing change in temperature of the second storage compartment 13 and change in temperature of the heating element before frosting of the second evaporator 22. FIG. 22 is a state graph showing change in temperature of the second storage compartment and change in temperature of the heating element after frost on the second evaporator is generated (when frosting is performed while exceeding permissible value).

As shown in the drawings, after the preceding frosting operation terminates, at S1, cooling operation of each storage compartment 12, 13 based on the first set reference temperature and the second set reference temperature is performed under the control of the controller 80, at S110.

At this point, the above-described cooling operation is performed under the operation control of at least any one of the first evaporator 21 and the first cooling fan 31 according to the first operational reference value designated on the basis of the first set reference temperature, and the cooling operation is performed under the operation control of at least any one of the second evaporator 22 and the second cooling fan 41 according to the second operational reference value designated on the basis of the second set reference temperature.

For example, when the internal temperature of the first storage compartment 12 is within the dissatisfaction temperature region divided on the basis of the first set reference temperature preset by the user, the controller 80 controls the first cooling fan 31 to be operated, and when the internal temperature is within the satisfaction temperature region, the controller 80 controls the first cooling fan 31 to stop operating.

At this point, the controller 80 controls the refrigerant valve 63 to selectively open and close the refrigerant path 61, 62, thereby performing the cooling operation with respect to the first storage compartment 12 and the second storage compartment 13.

Furthermore, the cooling operation with respect to the second storage compartment 13 is performed by supplying air (cold air) passing through the second evaporator 22 to the second storage compartment 13 by an operation of the second cooling fan 41, and cold air circulated in the second storage compartment 13 flows into the air inlet side of the second evaporator 22 with guidance of the inlet duct 42*a* constituting the second fan duct assembly 40, and then repeatedly performs flowing through the second evaporator 22.

At this point, most (e.g., about 98%) of the air flowing into the air inlet side of the second evaporator 22 with guidance of the inlet duct 42*a* passes through the second evaporator 22, and some (e.g., about 2%) of the air flows into the frosting detection flow path 710 through the fluid inlet 711 of the frosting detection flow path 710 located at the air inlet side of the second evaporator 22.

Specifically, the fluid outlet 712 of the frosting detection flow path 710 is disposed at a location considering a pressure difference with the fluid inlet 711 and is disposed at a location considering an effect of a pressure generated by an operation of the second cooling fan 41 (location considering a spacing from the second cooling fan).

Accordingly, air passing through the frosting detection flow path 710 is less affected by a pressure of the second cooling fan 41 and some air forcibly flows by a pressure difference between the fluid outlet 712 and the fluid inlet 711 even in non-frosting. Accordingly, minimum discrimination (temperature difference before and after frosting) for the frosting detection may be secured.

In addition, during the general cooling operation described above, confirming the cycle for the frost detecting operation is continuously determined, at S120.

At this point, the performance cycle of the frost detecting operation may be a cycle of time, and may be a cycle in which the same operation such as a specific component or operation cycle is repeatedly performed.

In the embodiment of the present disclosure, the cycle may be a cycle in which the second cooling fan 41 is operated.

In other words, considering that the frost detecting device 70 is configured to detect the amount of frosting on the second evaporator 22 on the basis of a temperature difference value (logic temperature ΔHt) in response to a change in the flow amount of air passing through the frosting detection flow path 710, as the logic temperature ΔHt becomes higher, the reliability of a detection result of the frost detecting device 70 may be secured, and when the second cooling fan 41 is operated, the highest logic temperature ΔHt may be secured.

At this point, the cycle may be each operation time of the second cooling fan 41 or alternating operation time of the second cooling fan 41. Of course, immediately after the defrosting operation terminates, since frequent performance of the frost detecting operation are not required, for example, the cycle may be preset such that the frost detecting operation is performed for every 3 operations of the second cooling fan 41.

Furthermore, the second cooling fan 41 of the second fan duct assembly 40 may be operated while the operation of the first cooling fan 31 of the first fan duct assembly 30 stops. Of course, when necessary, the second cooling fan 41 may be controlled to be operated also when the operation of the first cooling fan 31 does not completely stop.

In addition, in order to increase a difference between temperature values in response to change in the flow amount of air passing through the frosting detection flow path 710, the flow amount of air should be large. In other words, a change in the flow amount of air in which reliability cannot be secured is virtually meaningless or may cause an error in determination.

Considering this, it may be preferable that the frosting sensor 730 is operated when the second cooling fan 41 having a virtually valid change in the flow amount of air is operated. In other words, during operation of the second cooling fan 41, it may be preferable to control the heating element 731 of the frosting sensor 730 to emit heat.

The heating element 731 may be controlled to emit heat simultaneously while power is supplied to the second cooling fan 41, or the heating element 731 may be controlled to emit heat immediately after power is supplied to the second cooling fan 41 or when a certain condition is satisfied while power has been supplied to the second cooling fan 41.

In the embodiment of the present disclosure, it is illustrated that the heating element 731 is controlled to emit heat when the certain condition is satisfied while power is supplied to the second cooling fan 41.

In other words, when the cycle for the frost detecting operation comes, when the heating condition of the heating element 731 is confirmed, at S130, and then the heating condition is satisfied, the heating element 731 is controlled to emit heat.

As shown in FIGS. 19 and 20, the heating condition may include at least one of the condition, in which when power is supplied to the second cooling fan 41, raising the temperature in the frosting detection flow path 710 stops; the condition in which the temperature inside the frosting detection flow path 710 gradually rises by power supply to the second cooling fan 41, and then is turned downward; the condition in which the temperature of the second storage compartment 13 confirmed by the separate second temperature sensor 1*b* that senses the temperature inside the second storage compartment 13 drops over the preset range despite the power supply to the second cooling fan 41; the condition in which the temperature inside the second storage compartment 13 stops rising or falls; the condition in which the heating time of the heating element 731 is shorter than the remaining operation time of the second cooling fan 41; the condition in which the second cooling fan 41 is maintained at a middle speed or more; and the condition in which the rotation speed of the second cooling fan 41 is maintained without a change.

Of course, the heating condition may include at least any one basic condition of the condition in which after the second cooling fan 41 is operated and the preset time elapses, the heating element is controlled to automatically emit heat; the condition in which before the second cooling fan 41 is operated, the internal temperature (temperature detected by temperature sensor) of the frosting detection flow path 710 gradually falls; the condition in which the second cooling fan 41 is in operation; and the condition in which the door of the second storage compartment 13 is not opened.

In addition, when it is confirmed that the above-described heating condition is satisfied, while the heating element 731 emits heat under the control of the controller 80 (or control of sensor PCB) at S140.

Furthermore, the above-described heating of the heating element 731 is performed, and the temperature sensor 732 detects a material property in the frosting detection flow path 710, e.g., the temperature Ht1, at S150.

The temperature sensor 732 may detect the temperature Ht1 simultaneously while the heating element 731 emits heat, and after heat-emission of the heating element 731 is performed, the temperature sensor 732 may detect the temperature Ht1.

Specifically, the temperature Ht1 detected by the temperature sensor 732 may be the minimum temperature inside the frosting detection flow path 710 to be confirmed after the heating element 731 is turned ON.

The detected temperature Ht1 may be stored in the controller (or sensor PCB).

In addition, the heating element 731 emits heat for a preset heating time. At this point, the preset heating time may be a time that may have the discrimination for a change in temperatures inside the frosting detection flow path 710.

For example, it is preferable that the logic temperature ΔHt when the heating element 731 emits heat for the preset heating time has the discrimination except for the logic temperature ΔHt by predicted or unpredicted other factors.

The preset heating time may be the specific time, or may be the time that is variable in response to the peripheral environment.

For example, the preset heating time may be the time shorter than a difference between the time, which is required for the changed cycle when the operational cycle of the first cooling fan 31 for the cooling operation of the first storage compartment 12 is changed to be shorter than the preceding operational cycle, and the time required for the above-described heating condition.

Furthermore, the preset heating time may be the time shorter than a difference between the time changed when the operational time of the second cooling fan 41 for the cooling operation of the second storage compartment 13 is changed to be shorter than the preceding operational time, and the time required for the above-described heating condition.

Furthermore, the preset heating time may be the time shorter than the operational time of the second cooling fan 41 when the second storage compartment 13 is operated at the maximum load.

Furthermore, the preset heating time may be the time shorter than a difference between the time for the second cooling fan 41 to be operated in response to a change in the internal temperature of the second storage compartment 13 and the time required for the above-described heating condition.

Furthermore, the preset heating time may be the time shorter than a difference between the operation time of the second cooling fan 41 changed in response to the designated internal temperature of the second storage compartment 13 designated by the user and the time required for the above-described heating condition.

In addition, when the preset heating time elapses, while the supply of power to the heating element 731 is interrupted, heat-emission of the heating element 731 may stop, at S160.

Of course, even when the heating time does not elapse, supply of power to the heating element 731 may be controlled to be interrupted.

For example, when the temperature detected by the temperature sensor 732 exceeds a preset temperature value (e.g., 70° C.), the supply of power to the heating element 731 may be controlled to be interrupted, and when the door of the second storage compartment 13 is opened, the supply of power to the heating element 731 may be controlled to be interrupted.

When unexpected operation of the first storage compartment 12 (operation of first cooling fan) occurs, the supply of power to the heating element 731 may be controlled to be interrupted.

When the second cooling fan 41 is turned OFF, the supply of power to the heating element 731 may be controlled to be interrupted.

As described above, when heat-emission of the heating element 731 stops, a value of a material property of the frosting detection flow path 710 detected by the temperature sensor 732, i.e., the temperature Ht2 may be detected, at S170.

At this point, the temperature detection of the temperature sensor 732 may be performed simultaneously with the stop of heat-emission of the heating element 731, and may be performed after heat-emission of the heating element 731 stops.

Specifically, the temperature Ht2 detected by the temperature sensor 732 may be the highest internal temperature of the frosting detection flow path 710 detected at the time before and after the heating element 731 is turned off.

The detected temperature Ht2 may be stored in the controller 80 (or, sensor PCB).

In addition, the controller 80 (or sensor PCB) may calculate each logic temperature ΔHt on the basis of each detected temperature Ht1, Ht2, and may determine whether or not the defrosting operation with respect to the cooling source 22 (second evaporator) is performed, on the basis of the logic temperature ΔHt calculated as described above.

In other words, after calculating at S180 and storing a difference value ΔHt between the temperature Ht1 when the heating element 731 emits heat and the temperature Ht2 when heat-emission of the heating element 731 terminates, the controller 80 may determine whether or not the defrosting operation is performed, on the basis of the logic temperature ΔHt.

For example, when the logic temperature ΔHt is higher than the preset first reference difference value, the flow amount of air in the frosting detection flow path 710 is less, and thus the controller may determine that the amount of frosting of the second evaporator 22 is less than the amount of frosting required for the defrosting operation.

In other words, when the amount of frosting on the second evaporator 22 is less, a difference between a pressure at an air inlet and a pressure at an air outlet of the second evaporator 22 is small, and thus the flow amount of air flowing in the frosting detection flow path 710 is small, so that the logic temperature ΔHt is relatively high.

On the other hand, when the logic temperature ΔHt is lower than the preset second reference difference value, the flow amount of air in the frosting detection flow path 710 is large, so that the controller may determine that the amount of frosting on the second evaporator 22 is sufficient to perform the defrosting operation.

In other words, when the amount of frosting on the second evaporator 22 is large, a difference between a pressure at the air inlet and a pressure at the air outlet of the second evaporator 22 is great, and the flow amount of air flowing in the frosting detection flow path 710 is large due to the difference in pressure, so that the logic temperature ΔHt is relatively low.

At this point, the second reference difference value may be a value that is preset sufficiently to perform the defrosting operation. Of course, the first reference difference value and the second reference difference value may be the same value, or the second reference difference value may be preset as a lower value than the first reference difference value.

The first reference difference value and the second reference difference value may be one specific value or be a value in a range.

For example, the second reference difference value may be 24° C., and the first reference difference value may be the temperature in the range from 24° C. to 30*r*.

In addition, in response to a result of the above-described determination, when the logic temperature ΔHt detected by the controller 80 is higher than the preset first reference difference value, it may be determined that the amount of frosting of the second evaporator 22 has failed to reach the preset amount of frosting.

In this case, after operation of the second cooling fan 41 stops, frosting detection may stop until a following cycle is operated.

Next, the operation of the following cycle of the second cooling fan 41 is performed, and the process of determining whether or not the heating condition for the frosting detection is satisfied may be repeatedly performed.

However, when the logic temperature ΔHt detected by the controller 80 is lower than the preset second reference difference value, the controller determines that the second evaporator 22 exceeds the preset amount of frosting, and the defrosting operation may be controlled to be performed, at S2.

At this point, when the defrosting operation is performed, the logic temperature ΔHt for each frosting detection cycle that is stored may be reset.

Next, according to the embodiment of the present disclosure, a process S2 of performing the defrosting operation with respect to the second evaporator 22 will be described below.

First, after the heating element 731 is turned off, the defrosting operation may be performed by determination of the controller 80.

When the defrosting operation is performed, the first heater 51 constituting the defrosting device 50 may emit heat.

In other words, it is configured that heat generated by heat-emission of the first heater 51 is used to remove frost generated on the second evaporator 22.

At this point, when the first heater 51 comprising of the sheath heater is turned on, heat generated by the first heater 51 removes frost generated on the second evaporator by radiation and convection.

Furthermore, when the defrosting operation is performed, the second heater 52 constituting the defrosting device 50 may emit heat.

In other words, it is configured that heat generated by heat-emission of the second heater 52 is used to remove frost generated on the second evaporator 22.

At this point, when the second heater 52 comprising of the L-cord heater is turned on, heat generated by the second heater 52 is conducted into a heat-exchange fin, thereby removing frost generated on the second evaporator 22.

The first heater 51 and the second heater 52 may be controlled to emit heat simultaneously, or it may be controlled such that the first heater 51 emits heat preferentially and then the second heater 52 emits heat, or it may be controlled such that the second heater 52 emits heat preferentially and then the first heater 51 emits heat.

In addition, after heat-emission of the first heater 51 or the second heater 52 is performed for a preset time, heat-emitting of the first heater 51 or the second heater 52 stops.

At this time, even when the first heater 51 and the second heater 52 are provided together, the stopping of heat-emission may be performed in the two heaters 51 and 52, but may be controlled such that heat-emission of any one heater stops preferentially and then heat-emission of the other heater stops next.

The time for heat-emission of each heater 51, 52 may be preset by the specific time (e.g., 1 time, etc.) or may be preset by the time that is variable in response to the amount of frosting.

Furthermore, the first heater 51 or the second heater 52 may be operated at the maximum load, or operated at the load that is variable in response to the amount of defrosting.

In addition, when the defrosting operation depending on operation of the defrosting device 50 is performed, the heating element 731 constituting the frosting sensor 730 may be controlled to emit heat with the defrosting operation.

In other words, in the defrosting operation, considering that water caused by frost melting may also flow into the frosting detection flow path 710, it may be preferable that the heating element 731 also emits heat to prevent the flowing water from being frozen in the frosting detection flow path 710.

Furthermore, the defrosting operation may be performed on the basis of time, or temperature.

In other words, when the defrosting operation is performed for randomized time, the defrosting operation may be controlled to terminate, and when the temperature of the second evaporator 22 reaches the preset temperature, the defrosting operation may be controlled to terminate.

In addition, when operation of the above-described defrosting device 50 is completed, the first cooling fan 31 is operated at the maximum load to allow the first storage compartment 12 to reach the preset temperature range and then the second cooling fan 41 is operated at the maximum load, so that the second storage compartment 13 may reach the preset temperature range.

At this point, when the first cooling fan 31 is operated, the refrigerant compressed from the compressor 60 may be controlled to be supplied to the first evaporator 21, and when the second cooling fan 41 is operated, the refrigerant compressed from the compressor 60 may be controlled to be supplied to the second evaporator 22.

In addition, when the temperature conditions of the first storage compartment 12 and the second storage compartment 13 are satisfied, the above-described control for the frosting detection of the second evaporator 22 performed by the frost detecting device 70 is successively performed.

Of course, immediately after operation of the defrosting device 50 is completed, it may be preferable to detect remaining ice to determine whether or not additional defrosting operation is required.

In other words, when remaining ice is detected, an additional defrosting operation is performed even though the defrosting operation time does not come up, and the remaining ice may be completely removed.

Meanwhile, the defrosting operation may not be performed only based on the information obtained by the frost detecting device 70.

For example, due to the user's negligence, the door of any one storage compartment may be opened for a long time (including tiny-opening, etc.).

This state may be recognized by a sensor that performs opening detection of the door, and in this case, the defrosting operation may be preset to be forcibly performed when a certain time elapses without operating the frost detecting device 70.

Furthermore, when the frosting detection operation is not cyclically performed due to excessive frequent opening and closing of the door, without using the information obtained by the frost detecting device 70, the defrosting operation may be preset to be forcibly performed at preset time considering frequent opening and closing of the door.

Furthermore, after the defrosting operation is completed, the above-described cooling operation is performed at S110, and continuously, the frosting detecting operation for detecting frosting is performed again.

The refrigerator 1 of the present disclosure may provide a minimum difference in the material property without reference to whether or not frost is generated on the cooling source (second evaporator), as the fluid outlet 712 of the frosting detection flow path 710 is disposed in a location having the minimum discrimination for the frosting detection, so that frosting may be precisely detected and the defrosting operation may be performed at the right time.

Meanwhile, the refrigerator of the present disclosure is not limited to the structure of the above-described embodiment.

In other words, the location design for the fluid outlet 712 of the frosting detection flow path 710 constituting the refrigerator 1 may be applied to various types of refrigerators such as a refrigerator having a structure with one storage compartment, a refrigerator having a structure with one evaporator, etc.

The refrigerator of the present disclosure may be applied to a type of refrigerator in which a plurality of cooling fans is provided to one fan duct assembly.

FIGS. 23 to 27 are views showing a refrigerator according to a second embodiment of the present disclosure.

According to the second embodiment of the present disclosure, the refrigerator may has a structure in which a third storage compartment 14 may be located at the door 12*b* for opening and closing the first storage compartment 12.

At this point, the third storage compartment 14 may be a separate storage compartment provided to be divided from the first storage compartment 12. For example, an ice making water purifier 15 may be provided at an outer portion of the door 12*b* (referring to FIG. 23) and the third storage compartment 14 (referring to FIGS. 24 and 26) may be provided at an inner portion of the door 12*b* to serve as an ice making compartment that provides ice to the ice making water purifier 15.

In FIG. 24, the refrigerator 1 includes a cold air supply hole 16*a* and a cold air recovery hole 16*b* that are formed on an inner wall of the first storage compartment 12 so as to supply and recover cold air from the second fan duct assembly 40 to the third storage compartment, and guide holes 17*a* and 17*b* that supplies and recovers cold air to and from the third storage compartment 14. When the door 12*b* is closed the guide holes 17*a* and 17*b* match with the cold air supply hole 16*a* and the cold air recovery hole 16*b*.

In FIG. 25, guide ducts 18*a* and 18*b* are connected to the cold air supply hole 16*a* and the cold air recovery hole 16*b* and supplies and recovers cold air from the second fan duct assembly 40 to the cold air supply hole 16*a* and the cold air recovery hole 16*b*.

Furthermore, in the case of the refrigerator 1 including the third storage compartment 14, as shown in FIGS. 26 and 27, the first fan 44 and the second fan 45 together may be provided in the second fan duct assembly 40.

At this point, the first fan 44 may be a cooling fan that forcibly blow cold air to the second storage compartment 13 (e.g., freezing compartment), and the second fan 45 may be a cooling fan that forcibly blows cold air to the third storage compartment 14 (e.g., ice making compartment) provided in the door 12*b* of the first storage compartment 12 (e.g., refrigerating compartment door).

The first fan 44 may be installed to be located at a center portion of the shroud 43 (or fan grill) constituting the second fan duct assembly 40, and the second fan 45 may be installed at a side portion of the first fan 44.

Furthermore, the first fan 44 and the second fan 45 may be fans of the same type or size (same radius), or may be fans of difference types or sizes.

However, when the first fan 44 and the second fan 45 are fans of the same type (fans having same radius), a fluid inlet 44*a*, 45*a* in which respective fans are disposed may be formed into difference sizes. For example, a first fluid inlet 44*a* formed in the second fan duct assembly 40 for the first fan 44 may be formed larger than a second fluid inlet 45*a* formed in the second fan duct assembly 40 for the second fan 45.

Furthermore, it is preferable that the fluid outlet 712 of the frosting detection flow path 710 is located at a portion that does not deviate from opposite ends of the second evaporator 22 (cooling source). In other words, it is preferable that the fluid outlet 712 is located at a portion (portions 22*a*, 22*b*, 22*c* based on FIG. 28) where the fluid outlet 712 may be affected by pressure drop generated during frosting of the second evaporator 22.

For example, the fluid outlet of the frosting detection flow path 710 may be arranged to be located at the center portion of the second evaporator 22. In other words, referring to the drawing shown in FIG. 28, when the second evaporator 22 is divided into 3 parts in a transverse direction, the fluid outlet 712 may be located at a portion at a center part 22*a*.

In addition, as described above, when the first fan 44 and the second fan 45 are provided in one second fan duct assembly 40, the fluid outlet 712 of the frosting detection flow path 710 constituting the frost detecting device 70 may be located between the first fluid inlet 44*a* in which the first fan 44 is installed and the second fluid inlet 45*a* in which the second fan 45 is installed.

Specifically, the fluid outlet 712 of the frosting detection flow path 710 may be disposed between the outside of the radius D1 of the first fan 44 and the outside of the radius D2 of the second fan 45.

Of course, based on the first fan 44, the fluid outlet of the frosting detection flow path 710 may be located at the opposite portion to a location of the second fan 45, but in order to accurately determine a status (frosting) generated in the second evaporator 22 by the second fan 45, it is preferable that the fluid outlet 712 is located between the first fan 44 and the second fan 45.

In other words, the fluid outlet 712 is provided to receive both of an effect of the pressure caused by an operation of the first fan 44 and an effect of the pressure caused by an operation of the second fan 45, so that it is preferable that frosting of a portion adjacent to the first fan 44 and the second fan 45, among portions of the second evaporator 22, may be precisely detected.

The fluid outlet 712 of the frosting detection flow path 710 may be disposed between the outside of the radius D1*1.5 of the first fan 44 and the outside of the radius D2*1.5 of the second fan 45. In this case, it is also preferable that the fluid outlet 712 is disposed at a location considering the pressure distribution generated around the first fluid inlet 44*a* and the second fluid inlet 45*a*.

In the structure in which the fluid outlet 712 is located between the two fans 44 and 45, a distance L1 from a center portion of the first fan 44 to the fluid outlet 712 of the frosting detection flow path 710 may be farther than a distance from the center portion of the first fan 44 to the allowable lowest pressure region A1 within a pressure region generated by an operation of the first fan 44, and may be shorter than a distance from the center portion of the first fan 44 to the allowable highest pressure region B1 within the pressure region generated by an operation of the first fan 44.

Furthermore, a distance L2 from a center portion of the second fan 45 to the fluid outlet 712 of the frosting detection flow path 710 may be farther than a distance from the center portion of the first fan 44 to an allowable lowest pressure region (excessive negative pressure region) A2 within a pressure region generated by an operation of the second fan 45, and may be shorter than a distance from the center portion of the second fan 45 to an allowable highest pressure region (positive pressure region) B2 within the pressure region generated by an operation of the second fan 45.

A1 may be smaller than A2, and B1 may be smaller than B2.

A1 may be a region existing in a distance of 72 mm or more and 115 mm or less from the center portion of the first fan 44.

B1 may be a region existing in a distance of 200 mm or more and 300 mm or less from the center portion of the first fan 44.

A2 may be a region existing in a distance of 92 mm or more and 135 mm or less from the center portion of the second fan 45.

B2 may be a region existing in a distance of 220 mm or more and 320 mm or less from the center portion of the second fan 45.

In other words, the distance L1 from the center portion of the first fan 44 to the fluid outlet 712 of the frosting detection flow path 710 may be shorter than the distance L2 from the center portion of the second fan 45 to the fluid outlet 712 of the frosting detection flow path 710.

In the above-described structure, the second fan 45 forcibly blows cold air to a location farther than the first fan 44 (door for first storage compartment), so that the second fan 45 rotates at a rotation speed faster than the first fan 44 or is formed to have the fluid inlet 45*a* smaller than the first fan 44 in order to have a suction force greater than the first fan 44.

Considering this, the distance L2 from the center portion of the second fan 45 to the fluid outlet 712 of the frosting detection flow path 710 may be configured to satisfy a condition of 92 mm≤L2≤320 mm.

Of course, in order to increase a flow rate difference when frosting occurs on the second evaporator 22, the distance L2 from the center portion of the second fan 45 to the fluid outlet 712 of the frosting detection flow path 710 may be configured to satisfy a condition of 92 mm≤L2≤220 mm.

In order to further increase a flow rate difference when frosting occurs on the second evaporator 22, the distance L2 from the center portion of the second fan 45 to the fluid outlet 712 of the frosting detection flow path 710 may be configured to satisfy a condition of 92 mm≤L2≤135 mm.

In order to secure a flow rate sufficient to have the minimum discrimination even when frosting on the second evaporator 22 is insignificant, the distance L2 from the center portion of the second fan 45 to the fluid outlet 712 of the frosting detection flow path 710 may be configured to satisfy a condition of 135 mm≤L2≤320 mm.

In order to secure a flow rate sufficient to have excellent discrimination when frosting on the second evaporator 22 is insignificant, the distance L2 from the center portion of the second fan 45 to the fluid outlet 712 of the frosting detection flow path 710 may be configured to satisfy a condition of 135 mm≤L2≤220 mm.

In the above-described conditions, when arrangement is performed at a location where the distance L1 from the center portion of the first fan 44 to the fluid outlet 712 satisfy a condition of 72 mm≤L1≤300 mm simultaneously or the pressure P0 of the fluid outlet 712 of the frosting detection flow path 710 satisfies a condition of −2.6 Pa≤P0≤1 Pa simultaneously, the material property (flow rate difference or temperature value) having higher discrimination may be secured.

Meanwhile, FIG. 29 is a view showing an installation structure of the frosting detection flow path of the refrigerator according to a third embodiment of the present disclosure.

The refrigerator according to the third embodiment of the present disclosure is illustrated such that a portion having the fluid outlet 712 constituting the frosting detection flow path 710 is bent to be inclined or curved toward at least one of opposite side portions thereof.

In other words, the fluid outlet 712 is not located in line (aligned) with the fluid inlet 711 of the frosting detection flow path 710, and air may pass through the inside of the frosting detection flow path 710 by a pressure difference between the fluid inlet 711 and the fluid outlet 712.

Of course, the structure of the portion with the fluid outlet 712 may prevent the frosting detection flow path 710 from being directly supplied by an effect of a suction force according to an operation of the second cooling fan 41.

As described through the embodiments, a location of the fluid outlet 712 of the frosting detection flow path 710 applied to the refrigerator of the present disclosure may be designed in consideration of actual pressure distribution generated during an operation of each fan (first cooling fan, second cooling fan, first fan, second fan).

In other words, considering that the actual pressure distribution is not formed in a circular shape with each fan as the center, but is formed in a shape that is concentrated to a right lower side of the fan (referring to FIGS. 14 and 15), the refrigerator may be designed into various structures through determination of a location of the fluid outlet 712 considering the pressure distribution.

Therefore, the refrigerator of the present disclosure has an effect in that determination of the optimum location of the fluid outlet may be performed regardless of a model or a type of a refrigerator (or, fan duct assembly) or a location of the fluid outlet may be determined considering other components.

Furthermore, the refrigerator 1 of the present disclosure is configured to provide a location of the fluid outlet considering not only an effect of the pressure distribution generated by an operation of the second cooling fan 41 but also the pressure difference between the fluid outlet 712 and the fluid inlet 711 of the frosting detection flow path 710. Therefore, a location of the fluid outlet 712 of the frosting detection flow path 710 may be efficiently designed.

Furthermore, the refrigerator of the present disclosure is configured such that the region provided as the installation location of the fluid outlet 712 constituting the frosting detection flow path 710 is a location that may have the minimum discrimination for the frosting detection. Therefore, the frosting detection may be precisely performed.

The invention claimed is:

1. A refrigerator comprising:

a casing providing a storage compartment;

a door to open and close the storage compartment;

an evaporator to cool a fluid supplied to the storage compartment;

a fan duct assembly arranged between the storage compartment and the evaporator;

a frost detecting device to detect an amount of frost or ice generated on the evaporator a cooling fan to circulate the fluid around the evaporator to the storage compartment, wherein the fan duct assembly comprises a grille fan arranged between the storage compartment and the evaporator, a shroud arranged between the grille fan and the evaporator, the shroud coupled to the grille fan, an inlet duct formed at a lower portion of the grille fan to suction air from the storage compartment, a fluid inlet formed on the shroud through which cold air passing through the evaporator flows in, wherein the inlet duct is positioned to be spaced apart above a bottom surface of the casing and provides a flow path such that the fluid flows between the inlet duct and the bottom surface of the casing toward the evaporator, wherein the frost detecting device comprises a frosting detection flow path comprising a fluid inlet part into which the fluid flows in, a fluid outlet part through which the fluid is discharged, a frosting sensor to measure a material property of the fluid passing through an inside of the frosting detection flow path, wherein the frosting detection flow path is formed by recessing a surface of the grille fan, the surface facing an inlet of the evaporator, wherein the fluid inlet part opening toward a flow path of the fluid guided between the inlet duct and the bottom surface of the casing, wherein the fluid outlet part is formed by recessing a surface of the shroud, the surface facing an outlet of the evaporator, and wherein a distance L from a center portion of the cooling fan to the fluid outlet part of the frosting detection flow path is farther than a distance A1 from the center portion of the cooling fan to an allowable lowest pressure region generated by an operation of the cooling fan, and is closer than a distance B1 from the center portion of the cooling fan to an allowable highest pressure region generated by the operation of the cooling fan.

2. The refrigerator of claim 1, wherein the material property comprises at least one of temperature, pressure, and flow amount.

3. The refrigerator of claim 1, wherein the frosting sensor comprises a sensor and a detecting derivative heater.

4. The refrigerator of claim 1, wherein the refrigerator comprises a compressor to compress a refrigerant supplied to the evaporator and a refrigerant valve to adjust an amount of the refrigerant supplied to the evaporator.

5. The refrigerator of claim 1, wherein the distance L from the center portion of the cooling fan to the fluid outlet of the frosting detection flow path is configured to satisfy a condition of 72 mm≤L≤300 mm.

6. The refrigerator of claim 1, wherein the distance L from the center portion of the cooling fan to the fluid outlet of the frosting detection flow path is configured to satisfy a condition of 72 mm≤L≤200 mm.

7. The refrigerator of claim 1, wherein the distance L from the center portion of the cooling fan to the fluid outlet of the frosting detection flow path is configured to satisfy a condition of 72 mm≤L≤115 mm.

8. The refrigerator of claim 1, wherein the distance L from the center portion of the cooling fan to the fluid outlet of the frosting detection flow path is configured to satisfy a condition of 115 mm≤L≤300 mm.

9. The refrigerator of claim 1, wherein the distance L from the center portion of the cooling fan to the fluid outlet of the frosting detection flow path is configured to satisfy a condition of 115 mm≤L≤200 mm.

10. A refrigerator comprising:

a casing providing a storage compartment;

a door to open and close the storage compartment;

an evaporator to cool a fluid supplied to the storage compartment;

a fan duct assembly arranged between the storage compartment and the evaporator;

a frost detecting device to detect an amount of frost or ice generated on the evaporator; and a cooling fan to circulate the fluid around the evaporator to the storage compartment, wherein the fan duct assembly comprises a grille fan arranged between the storage compartment and the evaporator, a shroud arranged between the grille fan and the evaporator, the shroud coupled to the grille fan, an inlet duct formed at a lower portion of the grille fan to suction air from the storage compartment, a fluid inlet formed on the shroud through which cold air passing through the evaporator flows in, wherein the inlet duct is positioned to be spaced apart above a bottom surface of the casing and provides a flow path such that the fluid flows between the inlet duct and the bottom surface of the casing toward the evaporator, wherein the frost detecting device comprises:

a frosting detection flow path comprising a fluid inlet part into which the fluid flows in, a fluid outlet part through which the fluid is discharged, and a frosting sensor to measure a material property of the fluid passing through an inside of the frosting detection flow path, wherein the frosting detection flow path is formed by recessing a surface of the grille fan, the surface facing an inlet of the evaporator, and wherein the fluid inlet part opening toward a flow path of the fluid guided between the inlet duct and the bottom surface of the casing, wherein the fluid outlet part is formed by recessing a surface of the shroud, the surface facing an outlet of the evaporator, wherein the fluid outlet part is positioned at the central portion of the evaporator when the evaporator is divided into three sections in the transverse direction, and wherein a portion of the frosting detection flow path having the fluid outlet is bent into an inclined shape or curved shape so as to not be in line with the fluid inlet.

11. A refrigerator comprising:

a casing providing a first storage compartment;

a door to open and close the first storage compartment and the door having a second storage compartment;

an evaporator to cool a fluid supplied to the first storage compartment and a second storage compartment;

a fan duct assembly arranged between the first storage compartment and the evaporator;

a frost detecting device to detect an amount of frost or ice generated on the evaporator; and a first fan to circulate the fluid around the evaporator to the first storage compartment, a second fan to circulate the fluid around the evaporator to the second storage compartment, wherein the fan duct assembly comprises a grille fan arranged between the first storage compartment and the evaporator, a shroud arranged between the grille fan and the evaporator, the shroud coupled to the grille fan, an inlet duct formed at a lower portion of the grille fan to suction air from the first storage compartment, a first fluid inlet formed on the shroud for the first fan and a second fluid inlet formed on a side of the first fluid inlet of the shroud for the second fan, wherein the first fan and the second fan are formed same size, wherein the first fluid inlet is larger than the second fluid inlet, wherein the inlet duct is positioned to be spaced apart above a bottom surface of the casing and provides a flow path such that the fluid flows between the inlet duct and the bottom surface of the casing toward the evaporator, wherein the frost detecting device comprises a frosting detection flow path comprising a fluid inlet part into which the fluid flows in, a fluid outlet part through which the fluid is discharged, and a frosting sensor to measure a material property of the fluid passing through an inside of the frosting detection flow path, wherein the frosting detection flow path is formed by recessing a surface of the grille fan, the surface facing an inlet of the evaporator, and wherein the fluid inlet part opening toward a flow path of the fluid guided between the inlet duct and the bottom surface of the casing, wherein the fluid outlet part is formed by recessing a surface of the shroud, the surface facing an outlet of the evaporator, and wherein the fluid outlet part of the frosting detection flow path is disposed between the first fluid inlet and the second fluid inlet of the shroud.

12. The refrigerator of claim 11, wherein the fluid outlet part of the frosting detection flow path is disposed between an outside portion of a radius D1 of the first fan and an outside portion of a radius D2 of the second fan.

13. The refrigerator of claim 11, wherein the fluid outlet part of the frosting detection flow path is disposed between an outside portion of a radius D1*1.5 of the first fan and an outside portion of a radius D2*1.5 of the second fan.

14. The refrigerator of claim 1, wherein the distance A1 is a distance of 72 mm or more and 115 mm or less, and the distance B1 is a distance 200 mm or more and 300 mm or less.

* * * * *